US011730998B2

(12) United States Patent
Cernasov et al.

(10) Patent No.: US 11,730,998 B2
(45) Date of Patent: Aug. 22, 2023

(54) STRENGTH TRAINING WORKOUT TRACKING DEVICE AND METHOD

(71) Applicants: Andrei Cernasov, Ringwood, NJ (US); Nathalie Cernasov, Ringwood, NJ (US); Andre Cernasov, Ringwood, NJ (US); Trentino Pezzano, Hopatcong, NJ (US)

(72) Inventors: Andrei Cernasov, Ringwood, NJ (US); Nathalie Cernasov, Ringwood, NJ (US); Andre Cernasov, Ringwood, NJ (US); Trentino Pezzano, Hopatcong, NJ (US)

( * ) Notice: Subject to any disclaimer, the term of this patent is extended or adjusted under 35 U.S.C. 154(b) by 247 days.

(21) Appl. No.: 17/216,051

(22) Filed: Mar. 29, 2021

(65) Prior Publication Data

US 2021/0308524 A1 Oct. 7, 2021

Related U.S. Application Data

(60) Provisional application No. 63/003,634, filed on Apr. 1, 2020.

(51) Int. Cl.
*A63B 21/072* (2006.01)
*A63B 24/00* (2006.01)

(52) U.S. Cl.
CPC ..... *A63B 21/0726* (2013.01); *A63B 24/0087* (2013.01); *A63B 2220/16* (2013.01); *A63B 2220/40* (2013.01); *A63B 2220/51* (2013.01); *A63B 2220/54* (2013.01); *A63B 2220/833* (2013.01); *A63B 2225/50* (2013.01)

(58) Field of Classification Search
CPC ... A63B 21/0726; A63B 21/06; A63B 21/072; A63B 21/076; A63B 24/0087; A63B 24/0062; A63B 2220/833; A63B 2220/51
See application file for complete search history.

(56) References Cited

U.S. PATENT DOCUMENTS

| | | | | |
|---|---|---|---|---|
| 9,616,579 | B2 | 4/2017 | Yale | |
| 9,814,922 | B2 | 11/2017 | Moran et al. | |
| 11,027,166 | B1 * | 6/2021 | Francis | A63B 21/0722 |
| 11,273,344 | B2 * | 3/2022 | Zets | A61B 5/486 |
| 2008/0045388 | A1 | 2/2008 | Riley | |
| 2013/0090212 | A1 | 4/2013 | Wang | |
| 2016/0096063 | A1 * | 4/2016 | Reynolds | A63B 21/0722 482/139 |
| 2016/0101320 | A1 * | 4/2016 | Tsutsui | A63B 21/4043 482/8 |

(Continued)

FOREIGN PATENT DOCUMENTS

| | | | | |
|---|---|---|---|---|
| FR | 2972340 | A1 * | 9/2012 | A61B 5/225 |
| KR | 101677845 | B1 | 11/2016 | |
| WO | WO-2009021447 | A1 * | 2/2009 | A61B 5/1036 |

OTHER PUBLICATIONS

English translation for Laurent FR2972340A1 (Year: 2012).*
English translation for Wu WO2009021447A1 (Year: 2009).*

*Primary Examiner* — Gary D Urbiel Goldner
*Assistant Examiner* — Sara K. Conway

(57) ABSTRACT

A strength training grip device including at least two joined segments, the joined segments dimensioned to at least partially surround a handlebar of a weight training equipment. Each segment includes an inner surface and at least one force sensor disposed across the inner surface, the at least one force sensor to measure force in at least one direction.

20 Claims, 19 Drawing Sheets

(56) References Cited

U.S. PATENT DOCUMENTS

| | | | | |
|---|---|---|---|---|
| 2017/0304679 | A1* | 10/2017 | Orfield | A63B 21/0724 |
| 2017/0361159 | A1* | 12/2017 | Malcolm | H04M 1/72403 |
| 2019/0269967 | A1* | 9/2019 | Thomas | A63B 21/00185 |

* cited by examiner

STRENGTH TRAINING WORKOUT TRACKING DEVICE AND METHOD

CLAIM FOR PRIORITY

The present Application for Patent claims priority to U.S. Provisional Application No. 63/003,634 entitled "Appliance for Tracking Strength Training Workouts" filed Apr. 1, 2020, assigned to the assignee hereof and hereby expressly incorporated by reference herein.

TECHNICAL FIELD

The disclosed apparatus and methods generally relate to strength training, particularly, devices to track an individual's workout progress independent of the strength training equipment the individual is using.

BACKGROUND

The expected return from a strength exercise can be quantified by measurements of factors, including but not limited to, a force deployed, a size of the resulting displacement, velocity, acceleration, and direction. These factors combine to evaluate the work and power exerted by the user in the course of exercise routines against resistance by various exercise equipment. These measurements can then be related to the development of various muscle groups. The force being deployed is often that of a mass acting against the Earth's gravity, from the mass of the person exercising (pushups, chin-ups, etc.) to the mass of various types of exercise equipment (dumbbells, barbells), sometimes with mediation by diverse motion transmission mechanisms (gears, pulleys). Exercise routines consist of mechanical motions conducted by the user against static and dynamic resistance. Static resistance of an object (exercise equipment) manifests as forces such as the gravitational force G of a resting mass M ($G=Mg$, $g=9.81$ m/sec$^2$) or the force opposed by a stretched elastic band. Resistance may also manifest as torques such as torque a bike rider must apply to the bicycle crankset to start the bicycle moving forward.

Dynamic resistance is due to movement of an object and can be either linear or rotational around an axis. Dynamic resistance to linear movement takes the form of dynamic friction force $F_f$ or an inertial force that develops in response to accelerating a mass M and is proportional to the mass M and the value of the acceleration a (Newton's Second Law):

$$F=F_f+Ma$$

Dynamic resistance to rotational motion, such as rotation around the elbow or wrist, takes the form of a dynamic friction torque $\tau_f$ or an inertial torque opposing the motion and is proportional to the moment of inertia J of the object being rotated, with respect of the axis of rotation and the value of the resulting angular acceleration $\varepsilon$.

$$\tau=\tau_f+J\varepsilon$$

The moment of inertia of an object depends on mass distribution of the object with respect to the axis of rotation, being generally different for each of the standard rotational degrees of freedom (Roll, Pitch, Yaw) and different when measured with respect to the elbow and wrist axis.

To evaluate the work being done by the human body during a given exercise routine one must know the expected trajectory and timing of the exercise routine, the physical characteristics of the user (body dimensions, mass and moments of inertia of the moving upper arm, forearm and hand, etc.), and the physical characteristics of the equipment used (masses, static forces, and torques, moments of inertia at the point of interface with the human body, etc.).

SUMMARY

For workouts with poorly characterized equipment, workouts using a user's body as source of resistance, and workouts with stationary grips (and therefore zero velocity and acceleration), disclosed smart grip embodiments incorporate one or more force and torque sensors. The use of force sensors and torque sensors (torque sensors which in turn may use force sensors) alleviate the need for information regarding the mass being moved, various friction forces, and torques or various moments of inertia of the moving exercise equipment.

BRIEF DESCRIPTION OF DRAWINGS

The disclosed workout tracking device and method is described in detail in the following description with reference to the examples illustrated in the following figures.

DETAILED DESCRIPTION

In many cases, the physical characteristics of the equipment used (masses, static forces, moments of inertia at the point of interface with the human body) are unknown. In support of workouts with poorly characterized equipment, workouts using the body as a source of resistance, and workouts with stationary grips (and therefore zero velocity and acceleration), smart grips embodied herein incorporate one or more force and torque sensors.

The use of force sensors and torque sensors alleviates the need for information regarding a mass being moved, friction forces and torques, or various moments of inertia of the moving exercise equipment. Torque sensors may use a strain gauge, a pressure sensitive resistor or angle of displacement (angle of twist) sensor. In one embodiment a torque sensor consists of a force sensor placed at a known radius from the center of rotation, perpendicular to the axis of rotation and to the radius of rotation. Accordingly, the smart grips described herein are easier to use and are compatible with a much wider range of exercises and strength training equipment.

For simplicity and illustrative purposes, the principles of the embodiments are described by referring mainly to examples thereof. In the following description, numerous specific details are set forth in order to provide a thorough understanding of the embodiments. It is apparent that the embodiments may be practiced without limitation to all the specific details. Furthermore, the embodiments may be used together in various combinations.

Figure 1:
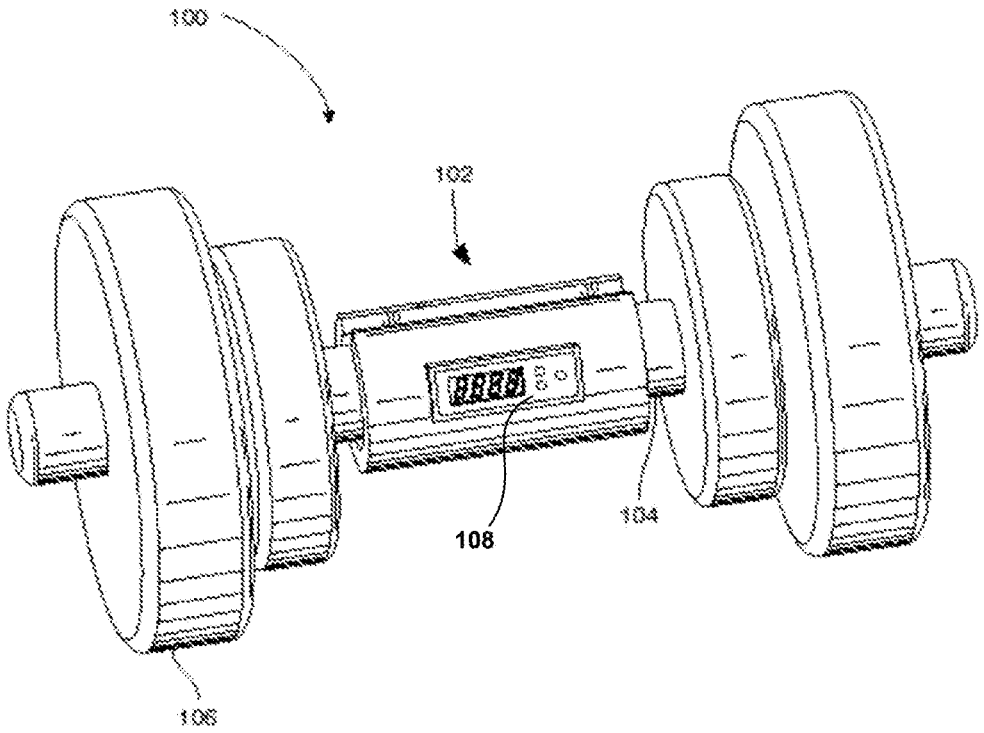
FIG. 1 illustrates, a workout tracking device, particularly a smart grip according to an example of the present disclosure.

A dumbbell, i.e., a type of free weight, is a piece of equipment used in weight training. FIG. 1 depicts a weight training dumbbell 100 that includes weight plates 106 mounted on ends of a handlebar 104. Smart grip 102 is dimensioned to substantially encircle handlebar 104. A user interface panel 108 is recessed into an outer surface of smart grip 102 and provides a user with real time status information of smart grip 102 as well as progress of the weight training applications and allows the user to input commands.

Figure 2A:
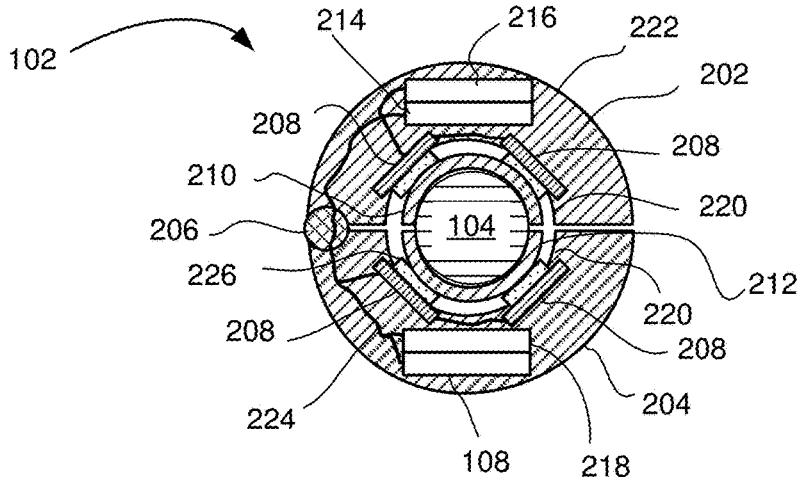
FIGS. 2A-2C illustrates three views of a pair of half-cylindrical segments of the smart grip in FIG. 1.

FIG. 2A depicts smart grip 102 as including a pair of outer half-cylindrical segments 202 and 204, the outer half-cylindrical segments 202 and 204 have inner surfaces 220 dimensioned to encircle a majority of bars or handles 104 of dumbbells, barbells, and exercise equipment handles. Outer half-cylindrical segments 202 and 204 have an outer surface dimension to comfortably fit within a grasp of a user.

In embodiments, outer half-cylindrical segments 202 and 204 may be replaced with four quarter-cylindrical segments, or other numbers of partial cylindrical or non-cylindrical segments, where each segment comprises an arc-segment less than or equal to 180 degrees, depending upon the number of segments.

Connecting member 206 attaches one side of outer half-cylindrical segment 202 to an opposing side of outer half-cylindrical segment 204. In an embodiment, connecting member 206 is a hinge, a flexible sheet, or other such connecting component to connect and urge together, outer half-cylindrical segments 202, 204. In an embodiment, connecting member 206 is spring loaded to urge a closed configuration of the outer half-cylindrical segments 202 and 204.

Grip device 102 includes at least one force sensor. FIG. 2A depicts an embodiment in which outer half-cylindrical segments 202, 204 accommodate a plurality of force sensors 208 that in disclosed embodiments are force sensing elements and include, but are not limited to piezoelectric load cells, strain gauges, and force sensing resistors. In an embodiment, force sensor 208 comprises a pressure sensor with an integral contact pad of known size. An applied force is calculated by multiplying a measured pressure by the size of the contact area. Other force sensors 208 may determine a change in electrical resistance of a wire when stress is applied to the wire.

A greater number of force sensors 208 results in more accurate measurements. Disclosed embodiments include at least six force sensors 208 disposed in at least six points of contact between the handlebar 104 of the strength training equipment and the smart grip 102.

Figure 2B:
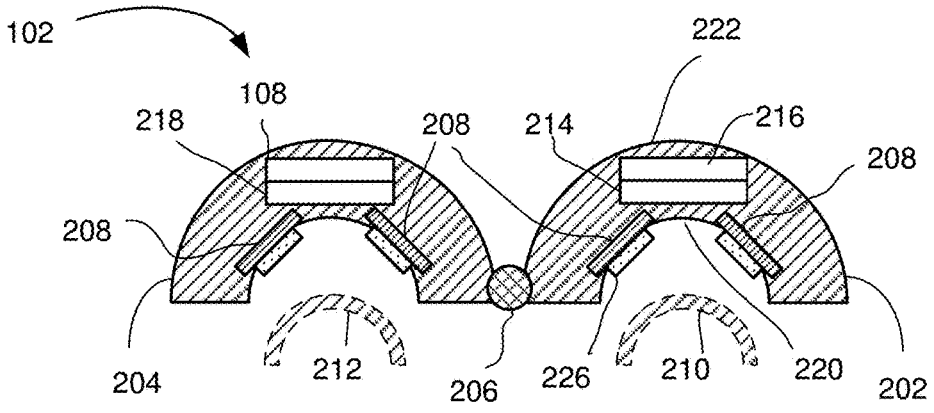
Figure 2C:
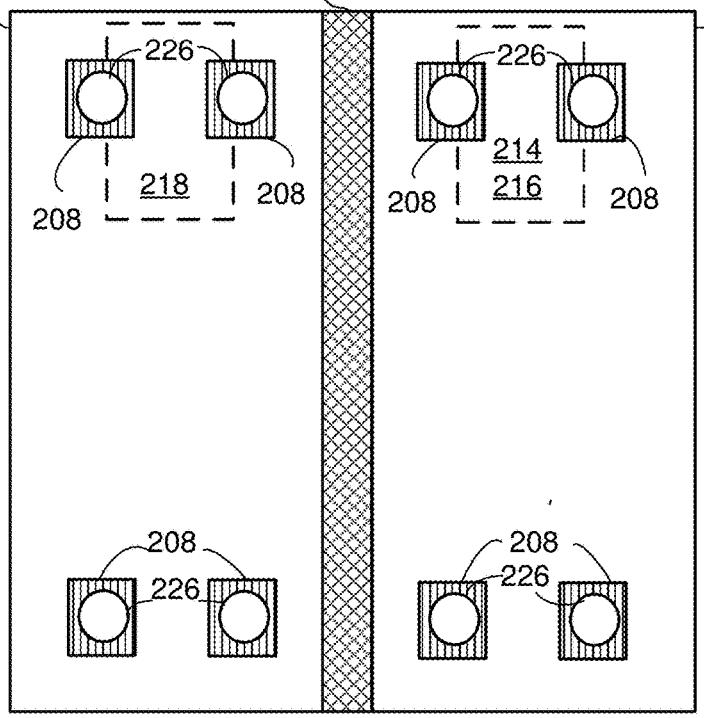

FIG. 2A-FIG. 2C depict an embodiment with eight force sensors 208 disposed within a length of a cylindrical smart grip 102. Four force sensors 208 are disposed towards each end of a cylindrical smart grip 102. Force information provided by the force sensors 208, together with acceleration and/or velocity data, is sufficient to calculate user effort for most exercise routines and most equipment. For higher accuracy and smaller motion ranges more force sensors 208 may be added.

By directly measuring the forces impinging on a user's body, in addition to linear and angular accelerations and/or velocities, described embodiments calculate quantities such as reaction forces and torques developed by the muscles, independent of a shape, mass, moment of inertia, or a geometry or chain of transmission of the equipment used. Adding timing of the measurements and trajectory of the exercise allows the described embodiments to compute mechanical work, expended energy, power and calorie counts.

Sensors 208 face inward towards a center of the outer half-cylindrical segments 202, 204. In an embodiment, contact pads 226 are integral to, or disposed on, force sensors 208. Force sensors 208 measure forces applied onto them by contact pads 226. In other embodiments, contact pads 226 are external to sensors 208, extending from an opposing member and engaging an active surface of sensors 208.

In FIG. 2A contact pads 226 extend slightly past an inner surface 220 of the outer half-cylindrical segments 202, 204. Force sensors 208 are dispersed across the inner surface 220 and map forces applied on an outer surface 222 of the outer half-cylindrical segments 202, 204, by measuring forces applied through the sensors 208 directly against the handlebar 104 or against force adaptor plates 210, 212 disposed between inner surface 220 and handlebar 104. Force adaptor plates 210 and 212 distribute the forces mapped through force sensors 208 along the surface of handlebar 104, irrespective of the details of the surface of the handlebar 104. In embodiments described below, force adaptor plates 210 and 210 accommodate different sizes and shapes of the handlebar 104.

In an embodiment, segment 202 is connected to segment 204 by hinge 206. In one embodiment the force adaptor plates 210, 212 are disposed concentrically, within the bounds of, and on the inner surfaces 220 of segments 202 and 204. Force adaptor plates 210, 212 ride on top of contact pads 226 of force sensors 208 and do not directly engage inner surfaces 220.

In one embodiment, force adaptor plates 210, 212 are inner half-cylindrical segments placed between the outer half-cylindrical segments 202, 204 and handlebar 104 of the strength training equipment. Force adaptor plates 210, 212 rest on the contact pads 226 and in some embodiments are fabricated with a rigid surface 230 on one side to rest on contact pads 226 and a thin pliable material on a handlebar 104 facing surface 232 such as to engage, without slippage, onto the handlebar 104.

In an embodiment, sensors 208 measure forces applied to the contact pads 226 by force adaptor plates 210, 212. In one embodiment sensor contact pads 226 are integral to force adaptor plates 210, 212.

A diameter and circumference of smart grip 102 is dimensioned so as to fit comfortably within a grasp of a user when the smart grip 102 is enclosed around handlebar 104.

Controller board 216 includes wireless communication capabilities, and is housed within one of outer half-cylindrical segments 202, 204. In embodiments, controller board 216 includes global sensors, including, but not limited to accelerometers, gyros, barometers, and timers. Accelerometers provide the necessary direct linear and angular acceleration data and, indirectly, velocity and displacement data, for the calculation of the work performed by the user during strength training routines. Alternately, gyros may provide direct velocity data and, indirectly, displacement and acceleration data. The joint use of accelerometers and gyros may deliver higher measurement accuracy. Barometer information may be used to scale the effort of the user according to the efficiency of the human body at different altitudes. Timers provide critical timing data for the exercise routines. Another function of the accelerometers is to ascertain the attitude of the smart grip 102 with respect to a direction of the gravitational acceleration g.

In an embodiment, user interface 108 is recessed into an outside surface of one of outer half-cylindrical segments 202, 204. User interface panel 108 receives data from controller board 216 and provides workout information to the user, including but is not limited real time status information of smart grip 102 as well as progress of the user's workout.

A signal conditioning circuit board 218 provides an interface between sensors 208 and controller board 216.

A battery 214 is disposed within smart grip 102 to provide power to components within the smart grip 208, including force sensors 208, controller board 216, user interface panel 108, and signal conditioning circuit board 218.

In an example, wiring harness 224 straddles outer half-cylindrical segments 202, 204 and connects one or more or battery 214, force sensors 208, signal conditioning board 218, controller board 216, and user interface panel 108.

Figure 3:
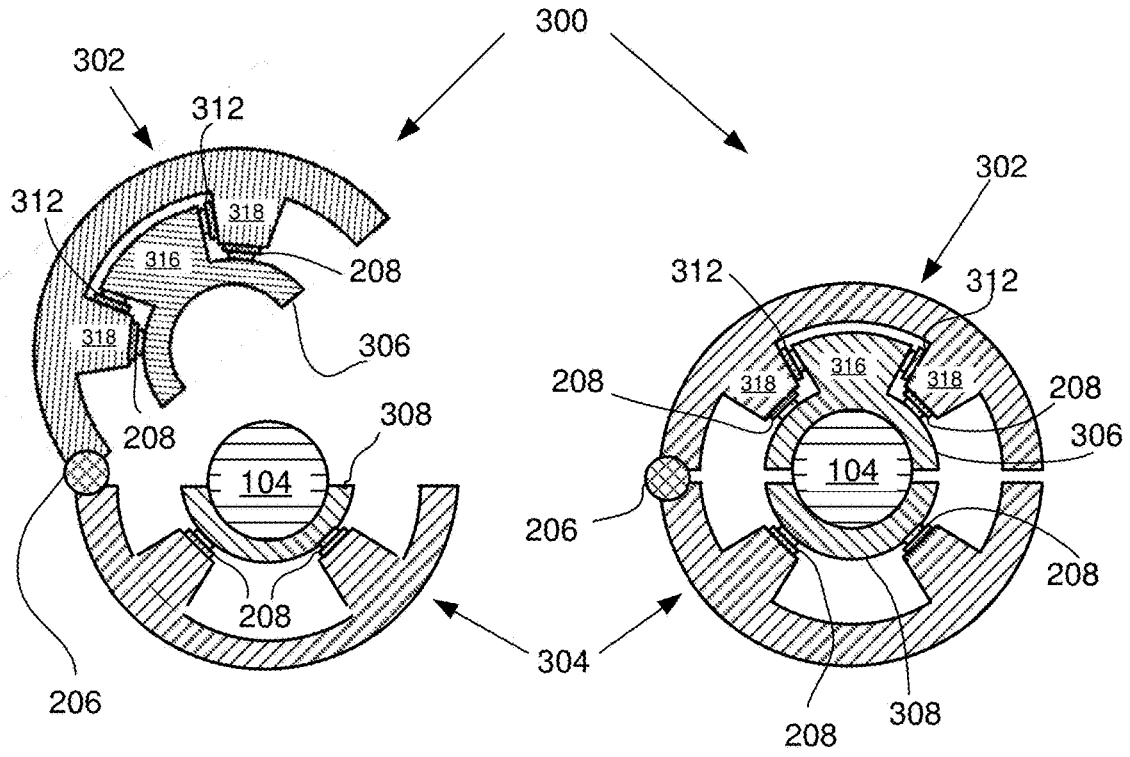
FIG. 3 illustrates a smart grip, depicted in FIG. 1, according to an example.

An embodiment of smart grip 300 is depicted in FIG. 3. Smart grip 300 measures tangential forces developed by actions that apply a torque to the smart grip 300. Smart grip 300 includes torque sensors consisting of force sensors 312 placed at a known radius from the axis of rotation of handlebar 104 and tangential to the rotational motion, when smart grip 300 is engaging handlebar 104. Force sensors 312 are disposed on engagement protrusions 318 of half-cylindrical segment 302. When a user applies a torqueing action to the grip 300, force sensors 312 detect tangential forces applied through interaction of protrusions 316 disposed on force adaptor plates 306. Using radial forces detected by force sensors 208 and tangential forces detected by force sensors 312, together with acceleration and velocity data from sensors on controller 216, mechanical work against equipment resistance and related exercise parameters may be calculated.

Figure 4A:
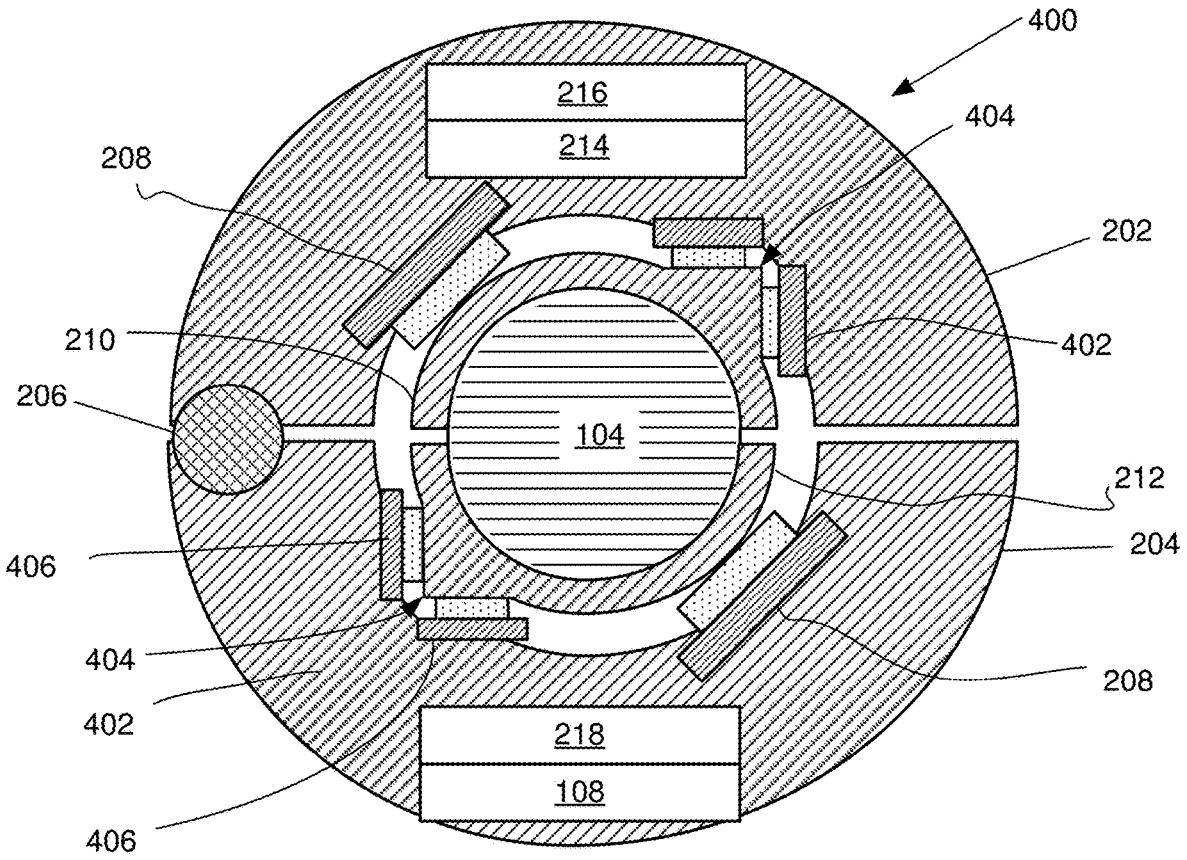
FIGS. 4A and 4B illustrate sensors disposed within a smart grip according to examples of the present disclosure.
Figure 4B:
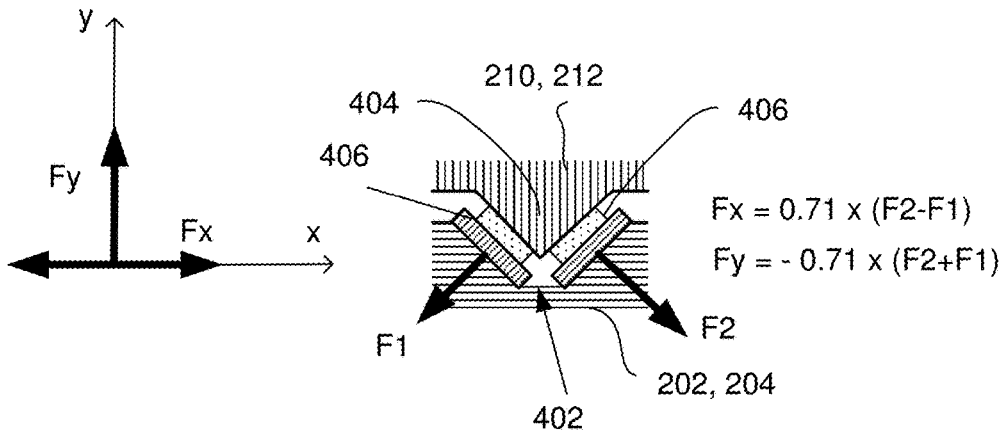

FIGS. 4A and 4B depict a compact smart grip embodiment 400 in which the radial and tangential forces are calculated from information provided by compound two-dimensional force sensors 402, each compound two-dimensional force sensor 402 including two non-coplanar force sensors 406. FIG. 4B depicts forces Fx and Fy calculated based on a compound two-dimensional positive force calculated from information provided by compound two-dimensional force sensor 402 having an angle of 90 degrees between force sensors 406.

Figure 5:
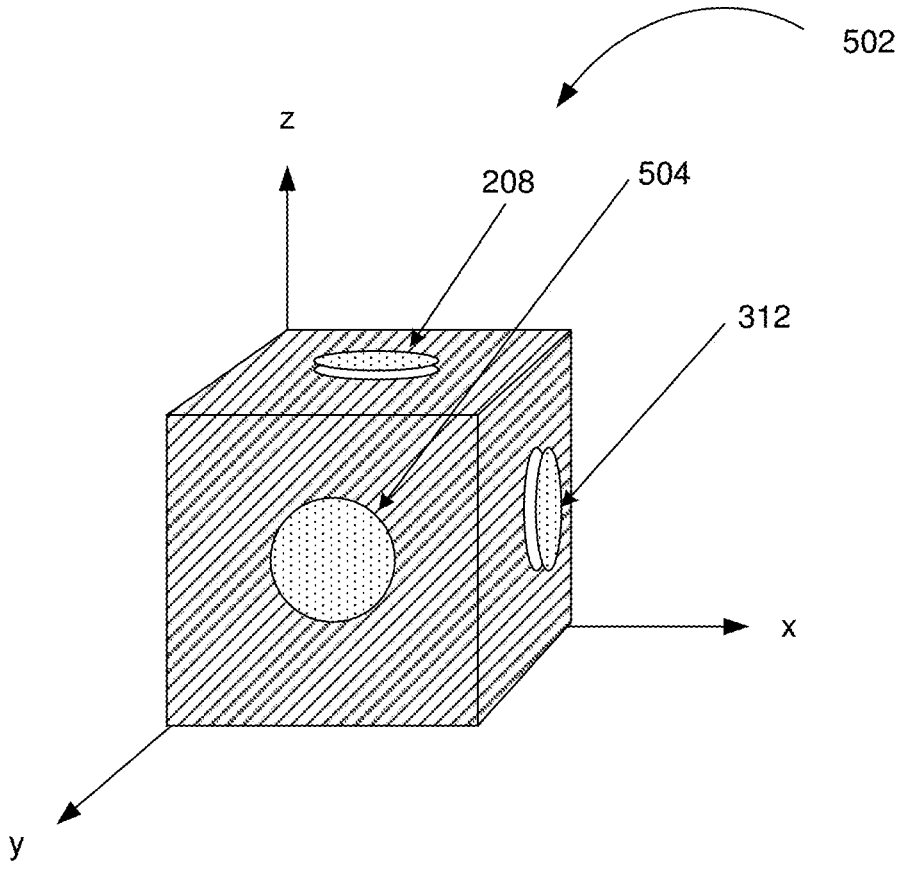
FIG. 5 illustrates Cartesian coordinate sensors according to examples of the present disclosure.

FIG. 5 depicts a three-dimensional positive force sensor 502 to detect radial, tangential, and axial forces, where axial forces are longitudinal to a length of a handlebar. FIG. 5 depicts force sensor 502 as including three discrete force sensors 208, 312, and 504 placed on three intersecting surfaces. In an embodiment, force sensors 208, 312 and 504 are identical. If the forces are in a Cartesian (x, y, z) coordinate system, the three intersecting surfaces are orthogonal. Three-dimensional positive force sensor 502 operates with any non-zero angle between any two of force sensors 208, 312, and 504. Making all angles between any two of force sensors 208, 312, and 504 90 degrees minimizes processing of data collected by the force sensors 208, 312, and 504. In an embodiment, the three-dimensional positive force sensor 502 is a single sensor capable of measuring forces in three dimensions.

Figure 6A:
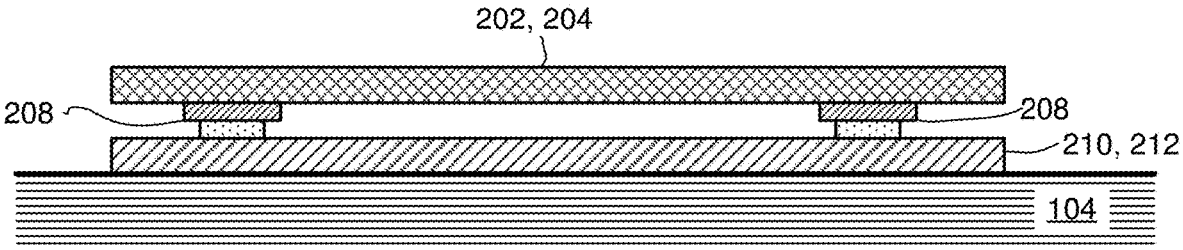
FIGS. 6A through 6D illustrate four sensor configurations, according to examples of the present disclosure.
Figure 6B:
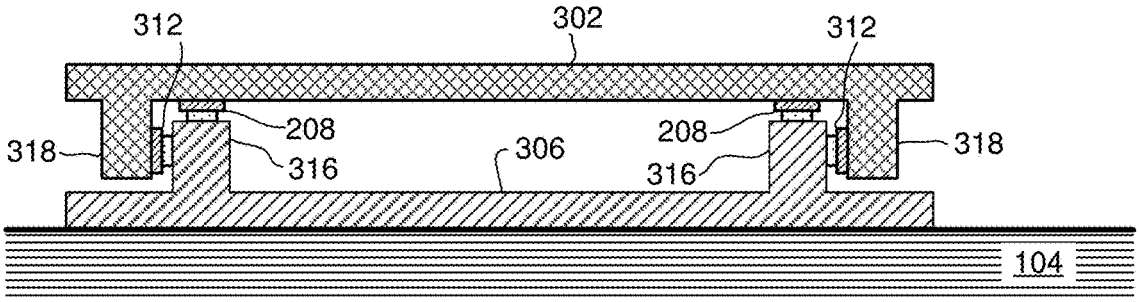

FIG. 6A depicts an embodiment of a smart grip device having only force sensors 208. FIG. 6B depicts a smart grip design that incorporates force sensors 208, similar to the embodiment in FIG. 6A, in addition to force sensors 312 that measure forces in an axial direction.

FIG. 6B further depicts protrusions 318 disposed on the outer half-cylindrical segment 302. Protrusions 318 arrest an axial motion of outer half-cylindrical segment 302 with respect to force adaptor plate 306. To engage protrusions 318, the force adaptor plate 306 includes protrusions 316 mechanically opposing protrusions 318. In an embodiment, force sensors 312 are disposed on protrusions 318 and are urged upon by protrusions 316.

Figure 6C:
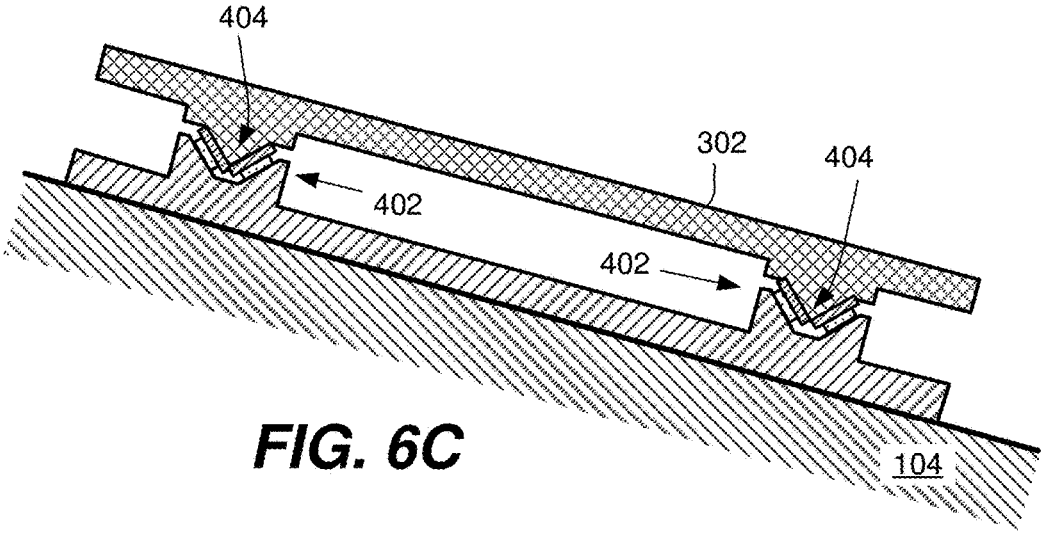
Figure 6D:
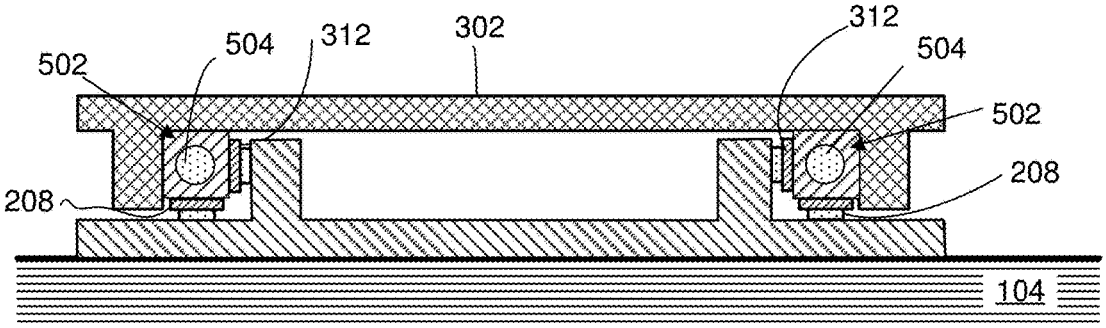

FIG. 6C incorporates compound two-dimensional force sensors 402 as described in the discussion above relative to FIGS. 4A and 4B. FIG. 6D depicts an embodiment that performs three-dimensional force measurements (radial, tangential and axial), and includes three discrete force sensors 208, 312, and 504 with known angles between any two of force sensors 208, 312, and 504. An embodiment includes multiple three-dimensional positive force sensors 502 that measures radial, tangential, and axial forces.

Figure 7A:
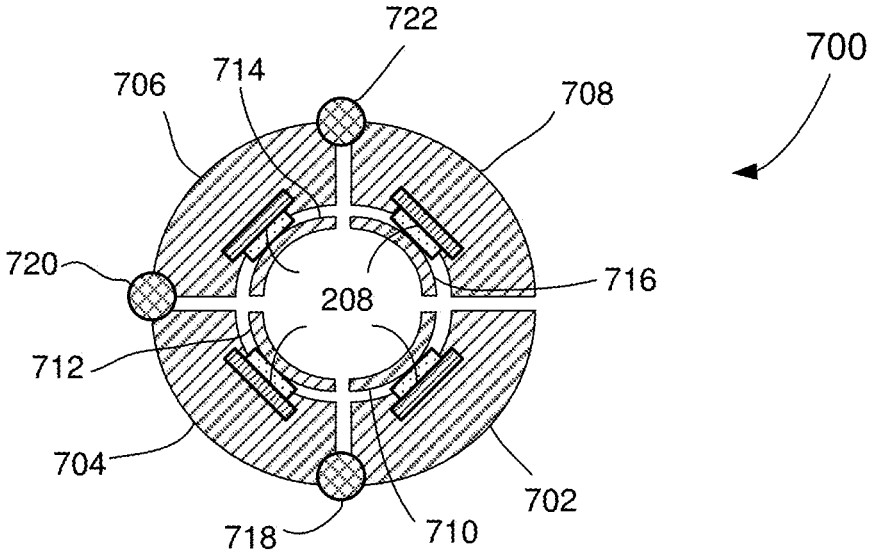
FIGS. 7A and 7B illustrate the smart grip as having four connected segments according to examples of the present disclosure.
Figure 7B:
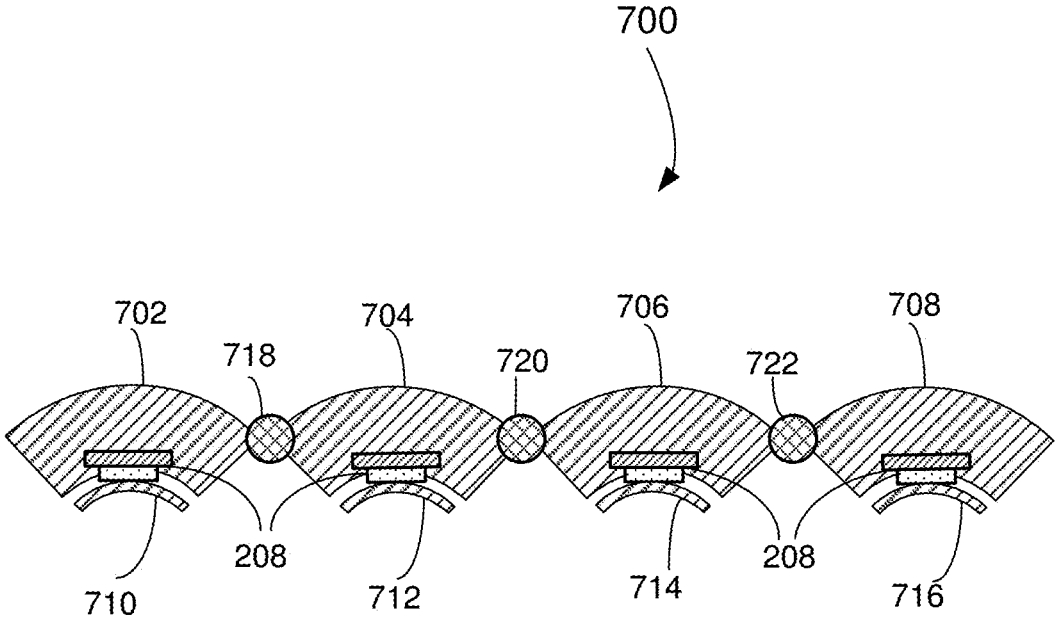

FIG. 7A and FIG. 7B depict a smart grip 700 that includes four individual outer quarter-cylinder segments 702, 704, 706, and 708 that have force sensors 208 disposed on an inner surface of segments 702, 704, 706, and 708. Force sensors 208 are in contact with, and measure a force applied to four quarter cylinder force adaptor plates 710, 712, 714, and 718. Outer quarter-cylinder segments 702, 704, 706, and 708 are connected together by connecting members 718, 720, and 722. In an example, connecting members 718, 720, and 722 are spring loaded hinges or other mechanism by which handlebar 104 is encircled by outer quarter-cylinder segments 702, 704, 706, and 708.

The four individual outer quarter-cylinder segments 702, 704, 706, and 708 are structured to accommodate sensors, actuators, power components and electronic circuitry similar to the components described above relative to FIGS. 2-4.

Figure 8A:
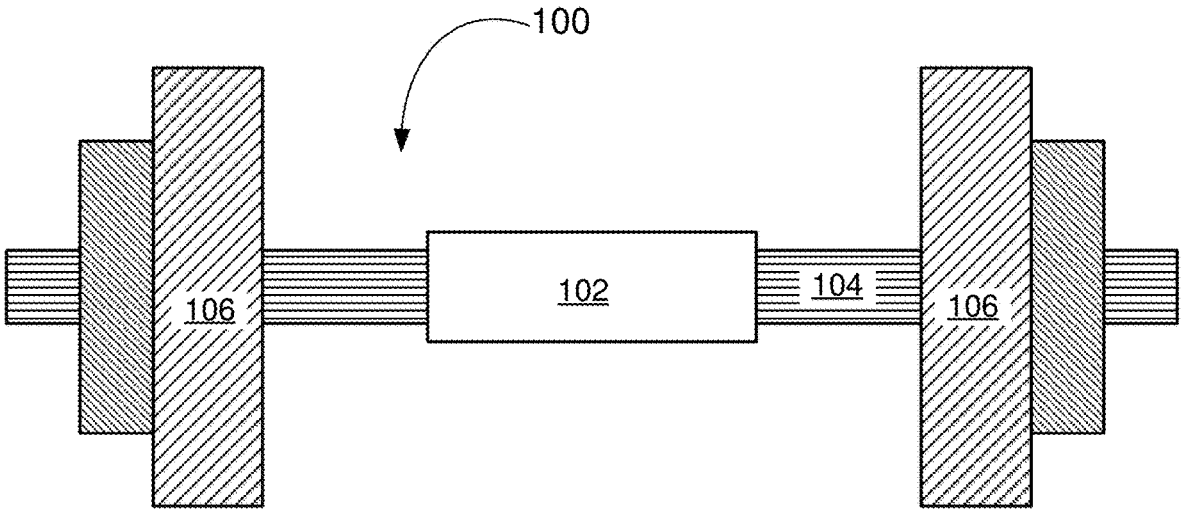
FIGS. 8A and BB illustrates a smart grip mounted on a dumbbell and handlebar of a training piece of equipment according to examples of the present disclosure.

FIG. 8A depicts a configuration of smart grip 102 used for encircling a handlebar 104 of dumbbell 100. Weights 106 are mounted on both ends of dumbbell 100.

Figure 8B:
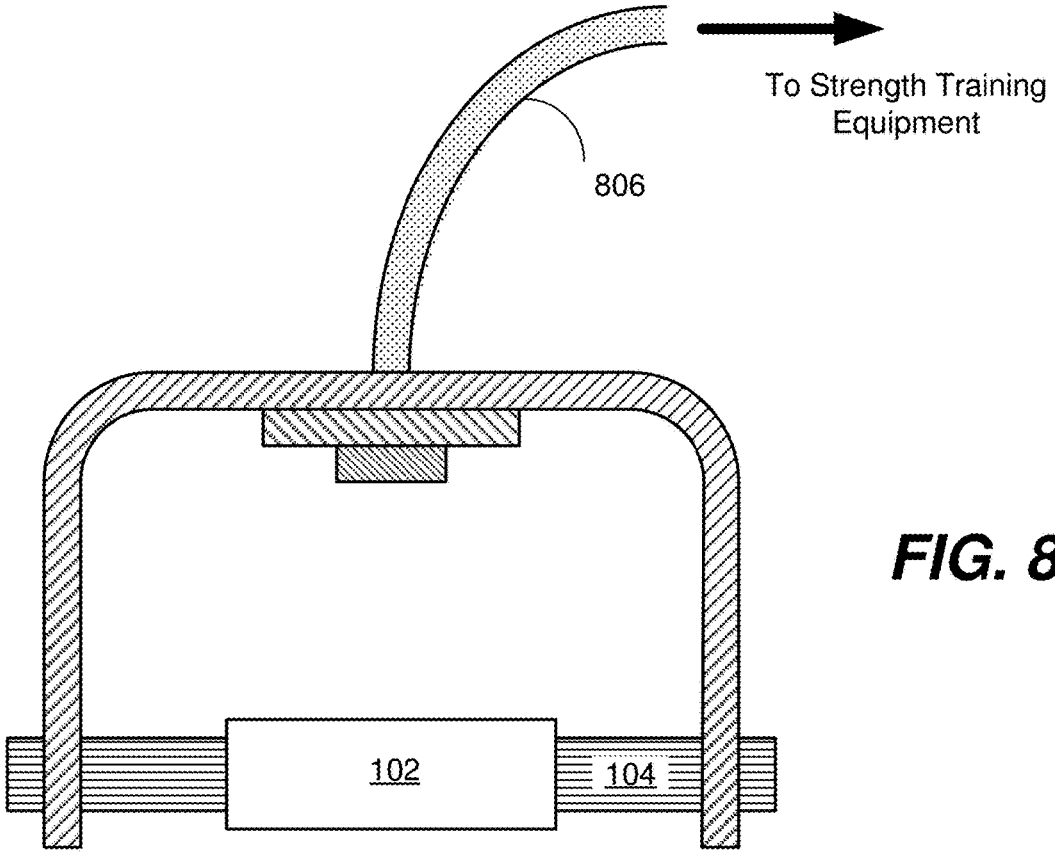

FIG. 8B depicts smart grip 102 encircling handlebar 104. Handlebar 104 is connected to strength training equipment by a cable 806 or other linkage mechanism.

Figure 9:
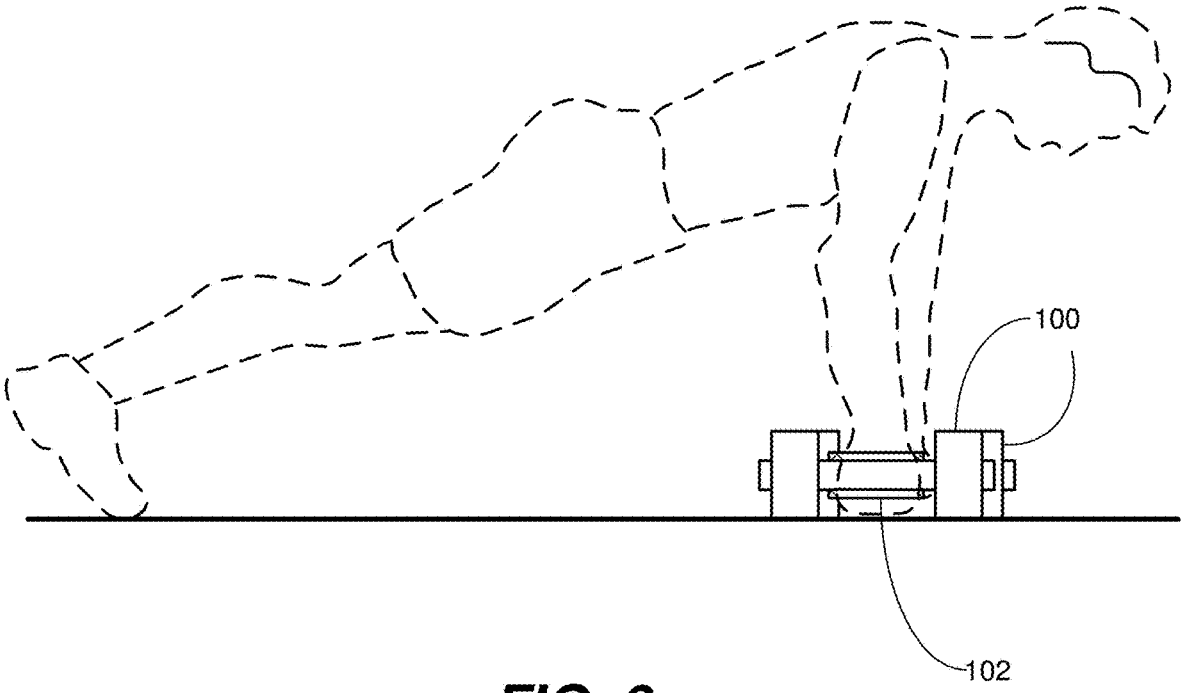
FIG. 9 illustrates an environmental view of a smart grip used in a push up exercise according to the present disclosure.

FIG. 9 depicts an environmental view of an individual performing weight training using dumbbells 100 equipped with grips 102 to record weight training statistics when performing pushup exercises.

Figure 10A:
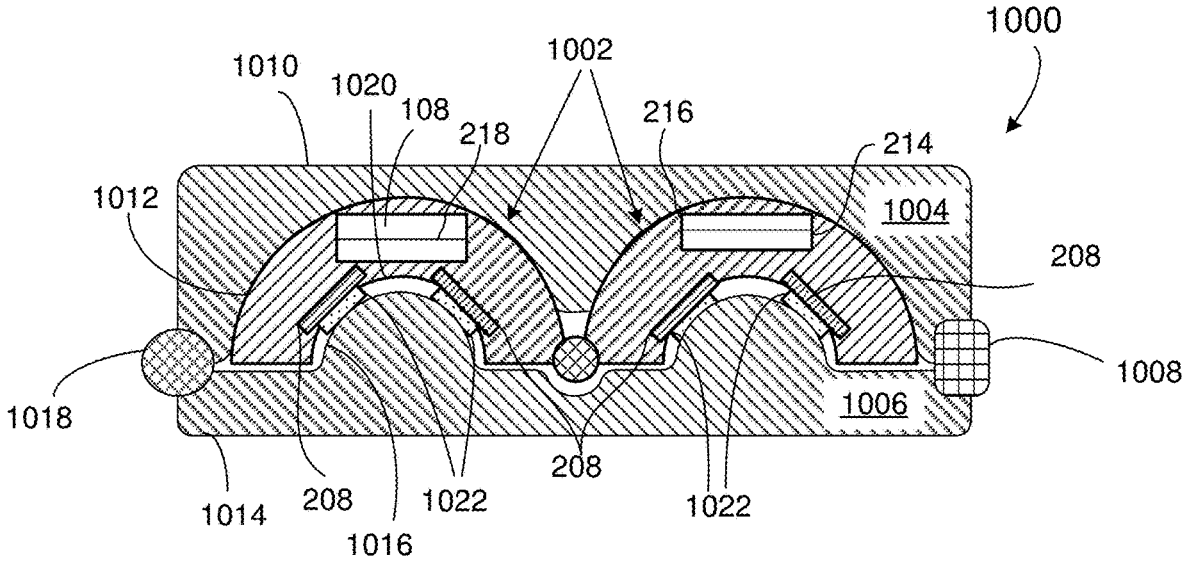
FIGS. 10A and 10B illustrates a smart grip operatively enclosed within an enclosure according to the present disclosure.

FIG. 10A depicts a smart grip 1002 secured within a flat surface hinged grip enclosure 1000 for exercises on flat surfaces. Grip enclosure 1000 is dimensioned to enclose smart grip 1002 in an open position. Grip enclosure 1000 includes a top plate 1004 and a bottom plate 1006. Top plate 1004 has a substantially flat upper surface and a contoured lower surface 1012. Bottom plate 1006 has a contoured upper surface 1016 and a substantially flat lower surface 1014 to provide stability when resting on a floor or other flat surface. In FIG. 10A, the contoured upper surface 1016 of grip enclosure 1000 replaces the force adaptor plates 210 and 212 depicted in FIG. 2.

When immobilized in enclosure 1000, smart grip 1002 is in a stationary position, and as such, precludes the use of inertial sensors to count exercise repetitions. To count repetitions, smart grip 1002, or an external computing device 1250, monitors lateral spatial cycles or temporal cycles of measured force values. A calculated average value of the measured force values is used to determine weight lifted data. Variations around the average value are used to calculate timing of the exercises.

A hinge or other attachment mechanism 1018 connects one side of top plate 1004 to bottom plate 1006. A latching mechanism 1008 secures an opposite side of top plate 1004 to bottom plate 1006. When snapped in its closed position as shown in FIG. 10A, sensors 208 are positioned to directly engage the contoured upper surface 1016. An inner surface 1020 of smart grip 1002 is spaced apart from contoured upper surface 1016 such that contact pads 1022 relay to sensors 208 force when force is applied to top plate 1004 relative to bottom plate 1006.

Figure 10B:
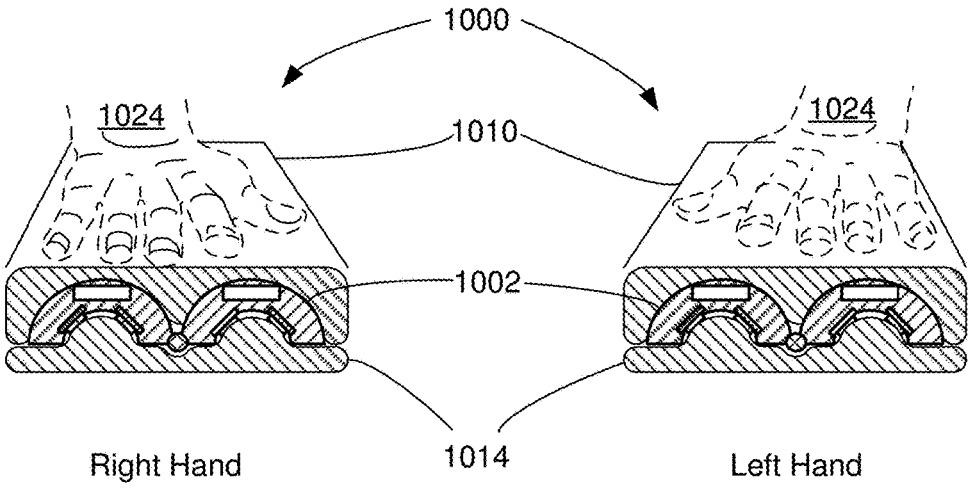
Figure 11:
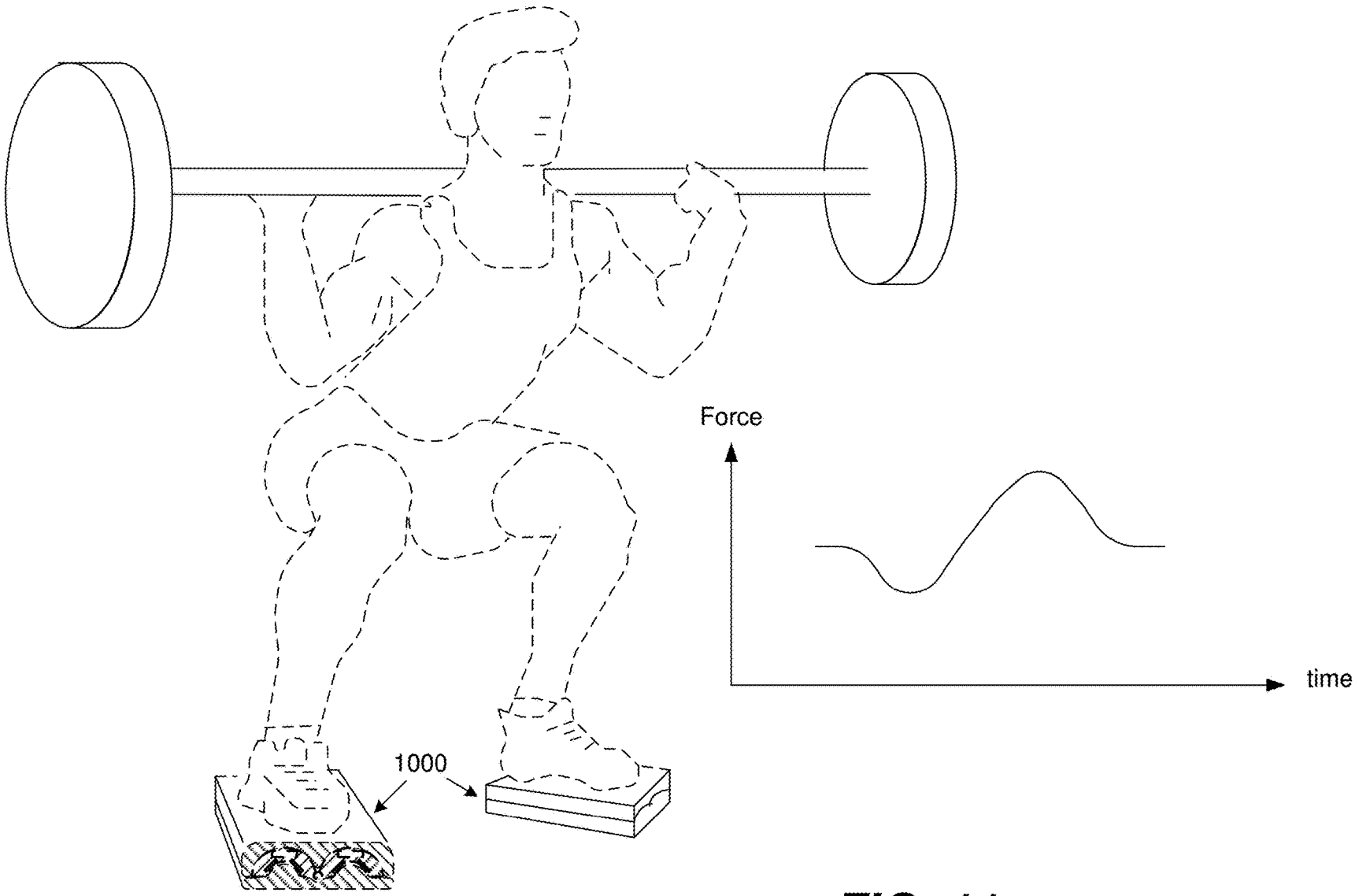
FIG. 11 illustrates an environmental view of the smart grip and enclosure according to FIGS. 10A and 10B.

Grip enclosure 1000 and smart grip 1002 allow a user to monitor strength exercises on strength training equipment that do not involve handlebars, such as push-ups (FIG. 10B) in which a user's hands 1024 press on upper surfaces 1010 of grip enclosure 1000. FIG. 11 depicts a user performing squat exercises while standing on a pair of grip enclosures 1000. FIG. 11 depicts a Force v. Time chart that displays data collected by sensors 208. The timing of the collected data may be used to count repetitions and calculate exerted work.

Figure 12A:
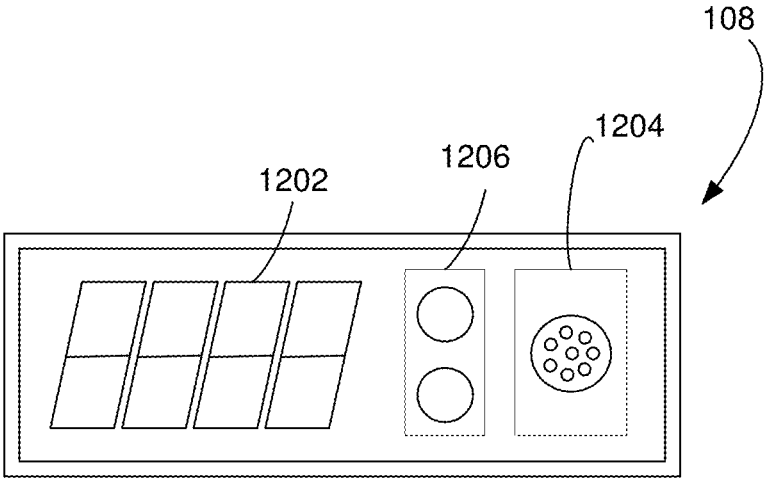
FIG. 12A depicts a user interface recessed within a smart grip, according to FIG. 1.

FIG. 12A is a detailed depiction of user interface panel 108 depicted in FIG. 1. User interface panel 108 is recessed into an outer surface of smart grip 102 and in disclosed embodiments includes input devices 1206 and output devices 1202 and 1204. Input devices 1206 include switches, pushbuttons, and/or microphone devices that allow a user to control an operation of smart grip 102. Output devices, include, but are not limited to, LED/LCD displays 1202 and speakers and haptic actuators (buzzer or vibration shaker) 1204 to provide the user with real time status information of smart grip 102.

User interface panel 108 provides needed information to the user when an external computing device 1250 is unavailable. In an example, the buzzer may be triggered by an alarm condition such as an unbalanced barbell or high pulse rate, while the LED may signal a low battery or external computing device out of range condition. It can also provide timing cues for the routines. LED/LCD display 1202 may provide raw data including, but not limited to, total weight lifted, the ID of the routine being executed or remaining number of repetitions in a given routine.

Input devices 1206 providing voice activated commands or fingerprint recognition, may be used to pause routine monitoring, pair multiple smart grips 102 and exercise equipment or input low level commands such as wakeup or hibernate. Biometric sensors, such as heart rate monitors, may also be incorporated.

Figure 12B:
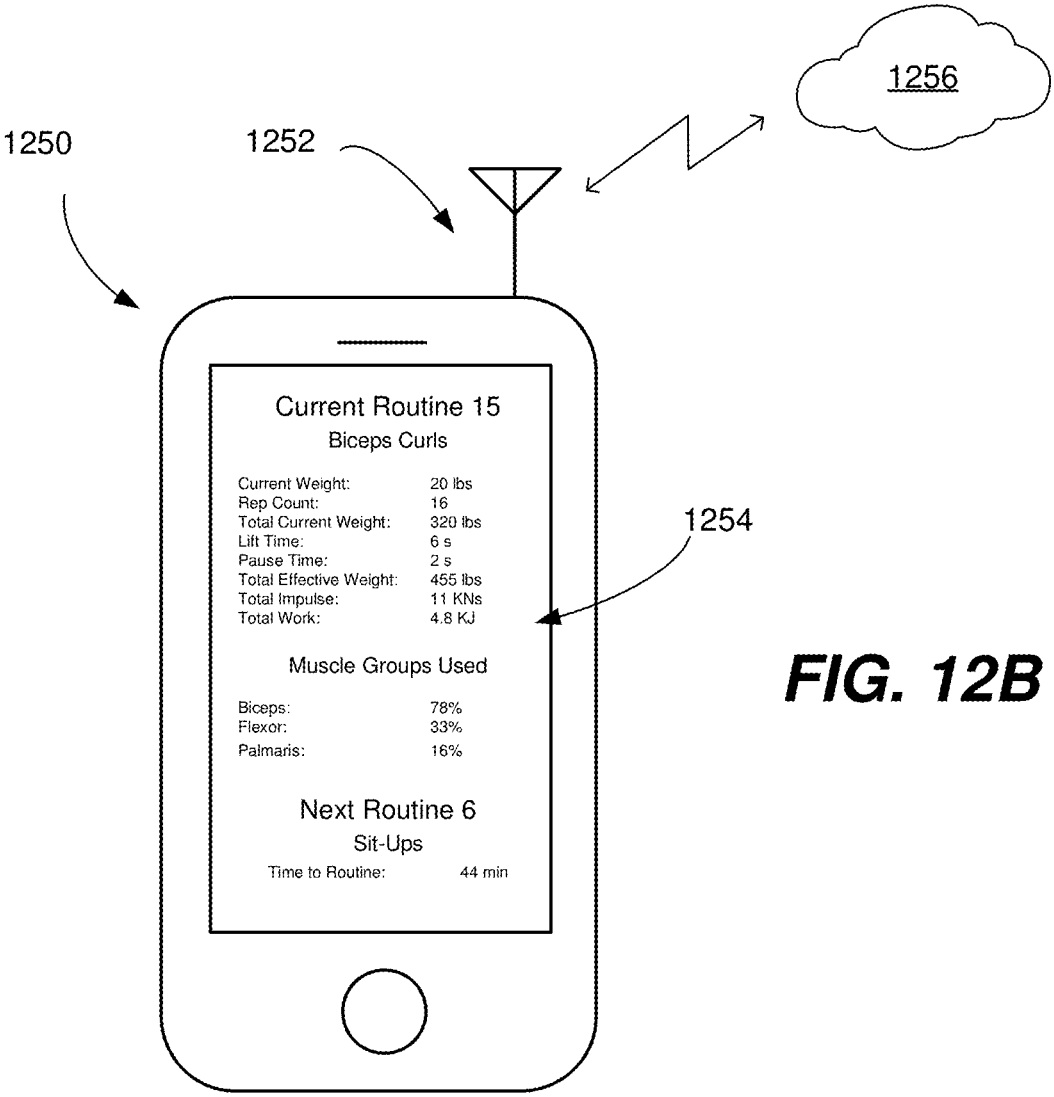
FIG. 12B depicts an external computing device that functions as a workout progress information processing and user interface according to another example of the present disclosure.

FIG. 12B depicts an external computing device 1250 that is external to smart grip 102 and, in disclosed embodiments, includes a user interface 1254 such as a touch screen, that allows a user to enter personal data and weight training information into the external computing device 1250 and a display screen 1254 to provide a user with feedback regarding progress in completing weight training applications hosted on the external computing device 1250.

In disclosed embodiments, external computing device 1250 includes, but is not limited to smartphone, tablet, desktop, and laptop computing devices. In an embodiment, external computing device 1250 includes at least one hardware processor, a computer readable medium, which may be non-transitory, such as hardware storage devices (e.g., RAM (random access memory), ROM (read only memory), EPROM (erasable, programmable ROM), EEPROM (electrically erasable, programmable ROM), and flash memory). External computing device 1250 is external to smart grip 102 and hosts a variety of weight training applications stored in one of the hardware storage devices within external computing device 1250. External computing device 1250 includes an antenna system 1252 to communicate with smart grip 102 via a wireless interface, e.g., a radio frequency (RF) interface and communicate with Cloud based resources 1256.

Figure 13:
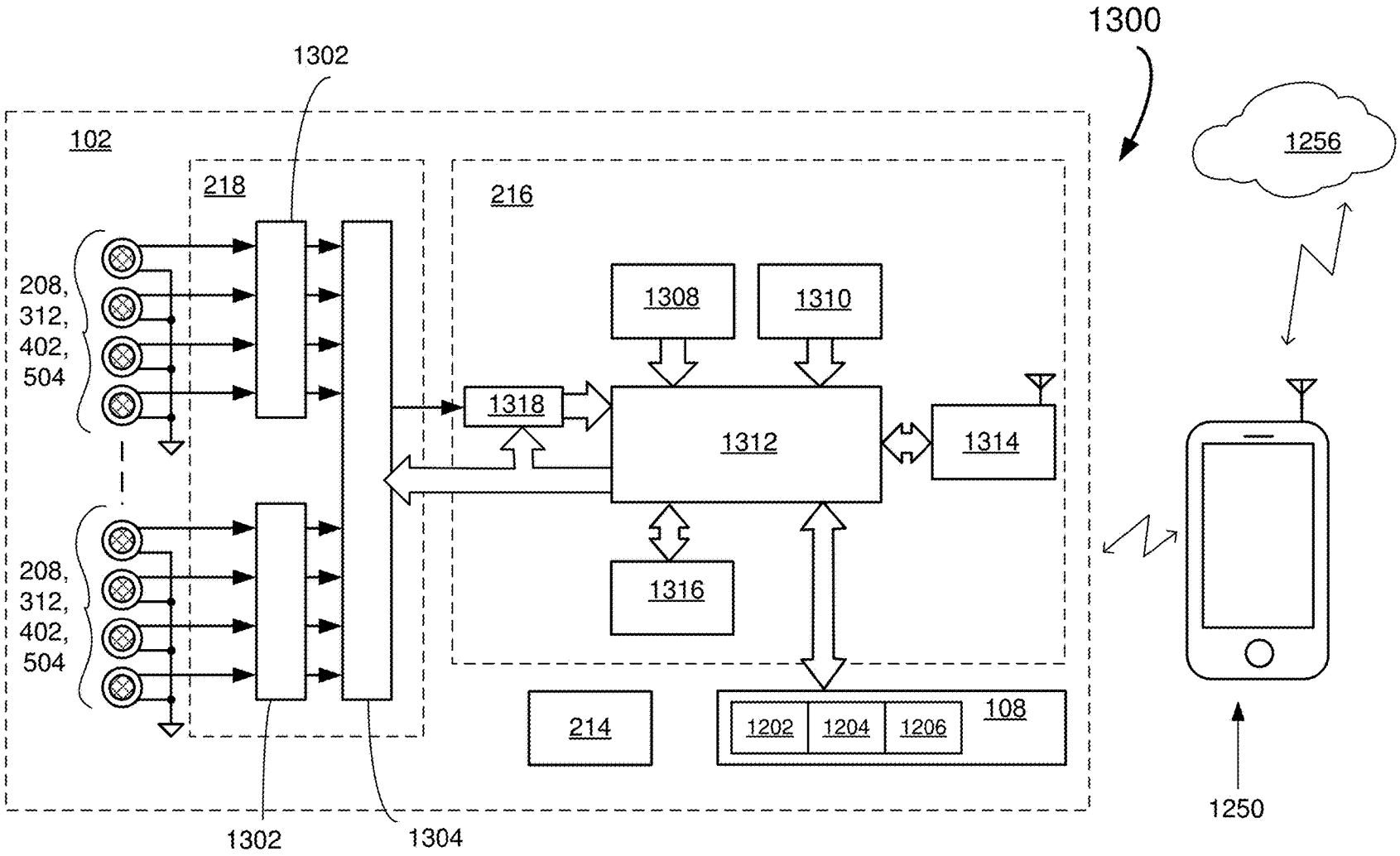
FIG. 13 depicts a block diagram of a workout tracking system for sensing, processing, and displaying workout progress, according to examples of the present disclosure.

FIG. 13 depicts a block diagram of a weight training tracking system 1300 organized as a standard Von Neumann computing system. System 1300 includes smart grip 102 and external computing device 1250. The block diagram of FIG. 13 further depicts smart grip 102 as including force sensors 208, 312, 402, and 504, conditioning board 218, and controller board 216. Controller board 216 includes a processor 1312 and provides the command and control functions required by RF module 1314 that provides the wireless interface with the external computing device 1250.

Conditioning board 218 includes circuitry that implements signal conditioners 1302 that converts an analog output of the force sensors 208, 312, 402, and 504 into an optimal range for conversion to digital format. Processor 1312 communicates with signal multiplexer 1304 and analog to digital (A/D) converter 1318 to control the selection and conversion of the conditioned outputs of force sensors 208, 312, 402, and 504, to a digital format. Processor 1312 stores the digitalized information in memory 1316.

Controller board 216 further includes local physical sensors 1308 that measure local physical parameters relevant to the operation of smart grip 102, including linear and angular acceleration, angular velocities, barometric pressure (altitude), and real time clock information. Also included are biological sensors 1310, that in embodiments monitor heart rate, blood pressure, and other information regarding the health status of the user.

In an example, processor 1312 interfaces with radio frequency (RF) module 1314 that includes Bluetooth and/or Wi-Fi transceivers to output data from force sensors 208, 312, 402, and 504, local physical sensors 1308, and biological sensors 1310 to external computing device 1250.

In an embodiment, user interface panel 108, including display panel 1202, inputs 1206, and actuators 1204, communicates with controller board 216 of smart grip 102 to provide the user with real time status information of smart grip 102 as well as progress of the weight training applications hosted on external computing device 1250.

In an example, processor 1312 continuously monitors operation of the smart grip 102. In embodiments communication with the external computing device 1300 may be continuous or intermittent. Memory 1316 buffers data to and from external computing device 1250, storing information to be transferred between smart grip 102 and external computing device 1250 in-between data transfers. Communication between the smart grip 102 and external computing device 1250 is mediated by the RF module 1314.

Command, control, and workout information is transmitted by external computing device 1250 and is received by processor 1312 via RF module 1314. Workout information is provided by the user and is inputted into external computing device 1250 via a user interface 1254. Workout information includes, but is not limited to one or more of routine ID, machine used, expected force and torque limits, number of repetitions (reps), timing data (length of rep, length of breaks), speed of grip motion, and acceleration. In an embodiment, feedback is provided to the user, in real time, by actuators 1204 and display 1202, including routine completion status, resistance outside limits, and abnormal or dangerous conditions such as a high pulse rate detected by biological sensors 1310. In an embodiment display 1202 provides immediate feedback, without requiring the external computing device 1250. In another embodiment the user can enter instructions directly into the controller 216 via input keys and switches 1206, such as pause or routine change, without using external computing device 1250.

Figure 14:
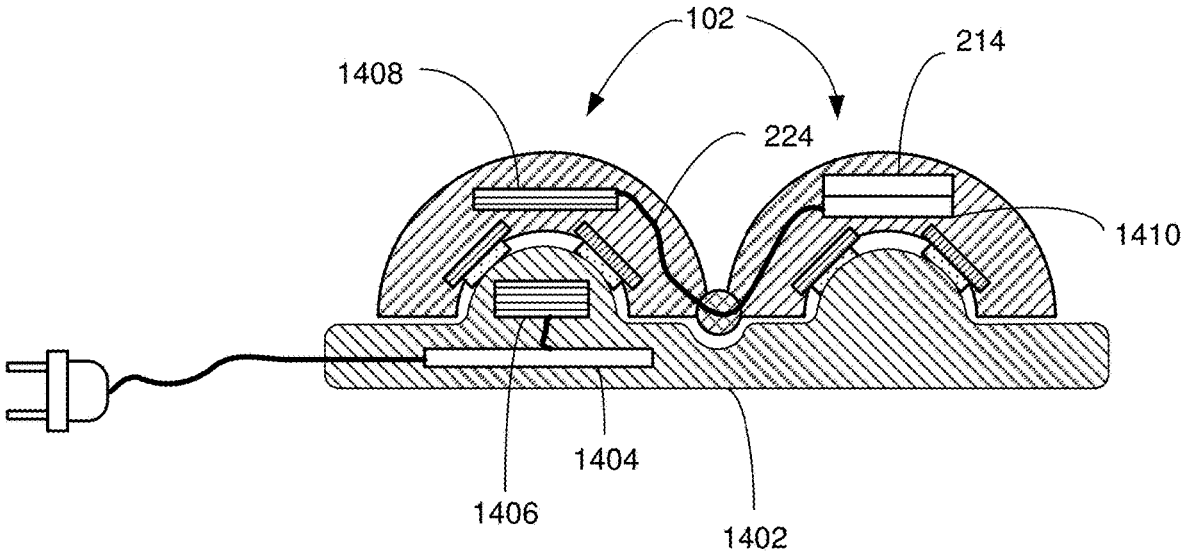
FIG. 14 illustrates a charging station of the workout tracking device of FIG. 1, according to an example of the present disclosure.

FIG. 14 depicts a wireless charging station 1402 to recharge battery 214. Wireless charging station 1402 includes a wireless recharger power transmitter board 1404, wireless recharger power transmitter antenna 1406, a wireless recharger receiver antenna 1408, a wireless receiver and battery management board 1410 and battery 214.

Method of Using the Workout Tracking Device

Figure 15:
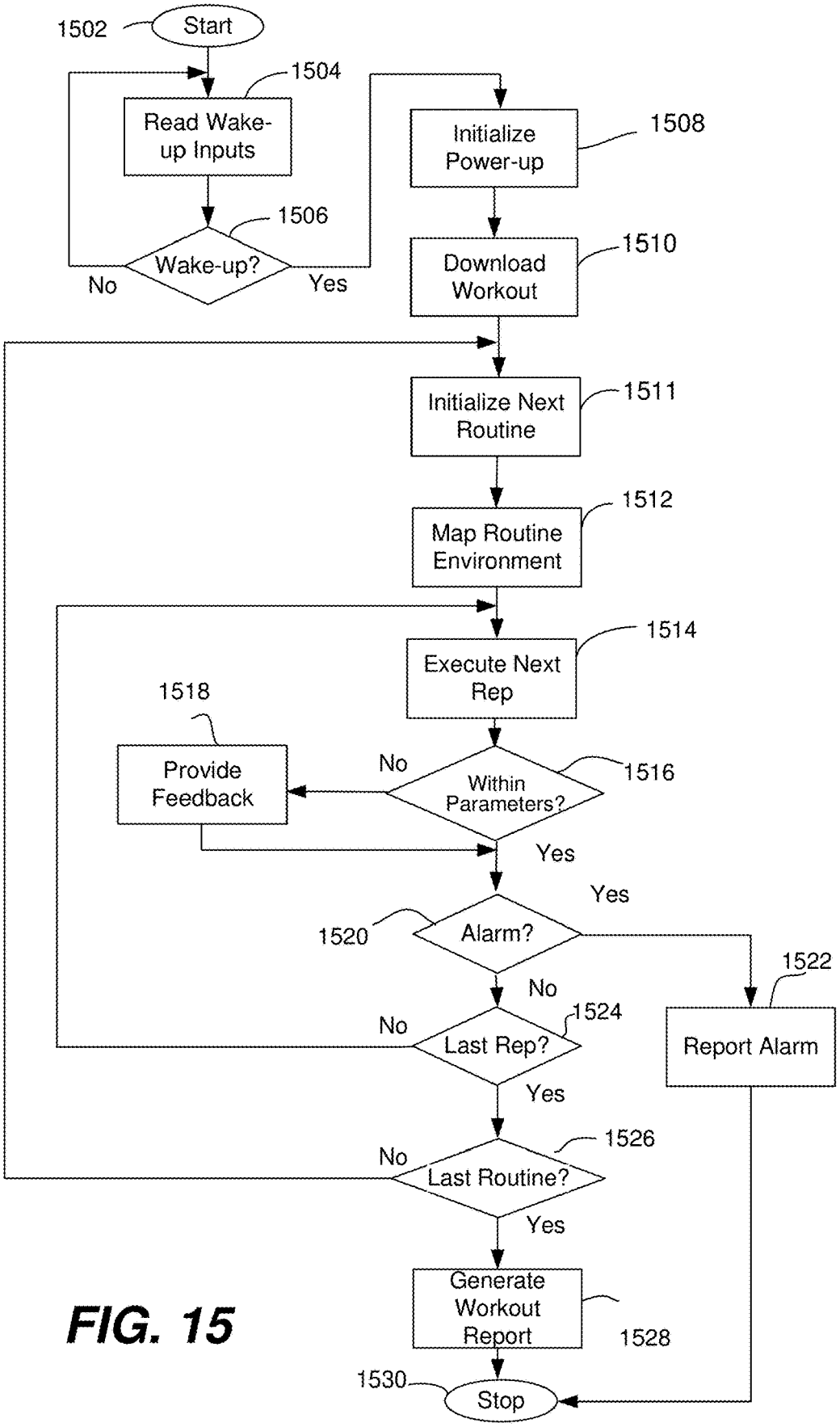
FIG. 15 illustrates a flowchart depicting a workout tracking flowchart executed by the workout tracking system according to an example of the present disclosure.

FIG. 15 depicts a flowchart describing operation of smart grip 102 and external computing device 1250 based upon programmable code stored in memory and executed by processor 1312 and a processor in external computing device 1250. On initial setup at block 1502 the external computing device 1250 records a user biological profile inputted by the user, including for example, gender, age, height and weight, as well as more detailed metrics including limb lengths, and health status. Default values are averages across similar user groups.

In an example, the user creates a workout schedule comprising a warm-up set, an exercise set, and a cool-down set of strength training routines. Each routine is defined by programmable parameters such as a type of machine used, resistance settings of the machine, time under resistance, break time, number of repetitions, number of series, left-right sequence, etc.

Strength training equipment generally exercise groups of muscles, and not one muscle at a time. For better tracking, external computing device 1250 tallies a cumulative effect of all the routines of a selected workout have on individual muscles and muscle groups. The tallied data allows the user, or a physical therapist, to reverse engineer sequences of routines to develop certain muscles while avoiding exercising others which may be injured.

Each workout session entered by the user is converted into low level commands by the external computing device 1250. External computing device 1250 communicates the low level commands to processor 1312 on smart grip 102 via wireless interface 1314. In turn processor 1312 of smart grip 102 supplies the external computing device 1250 with information it needs to make necessary calculations and perform reporting functions. The information supplied to the external computing device 1250 may range from low level raw sensor data to high end processed artificial intelligence (AI-at-the-edge) statistics.

Grip 102 is wrapped substantially around the handlebar 104 of a desired strength training equipment. At blocks 1504, 1506, and 1508, a movement of smart grip 102, and/or detection of a force exerted on sensors 208, 312, 402, 504 wakes-up electrical components of smart grip 102 and establishes wireless communication with the external computing device 1250.

At block 1510, a workout profile selected by the user is downloaded onto the smart grip 102. At block 1511, processor 1312 on smart grip 102 initializes a next exercise routine. At block 1512, processor 1312 records a workout environment, including environmental parameters (such as altitude and temperature). In addition, at block 1512, processor 1312 determines (see FIGS. 19B and 19C and related discussion) a grip angle β the smart grip must be open in order to accommodate a particular handlebar in use.

At blocks 1514-1526, smart grip 102 monitors exercise parameters specific to the execution of the workout routines, including data provided by force sensors 208, 312, 402, 504, local physical sensors 1308, and biological sensors 1310 for compliance (block 1516) with the requirements of the routine, including, but not limited to resistance levels (weight being lifted), and timing.

Furthermore, processor 1312 determines whether the monitored exercise parameters are consistent with the exercise routine programmed and selected by the processor 1312. For example, FIG. 10 depicts dumbbells 100 being used as push-up supports and not for biceps curls.

At step 1518, real time feedback is provided to the user If the monitored exercise parameters are outside predetermined limits. Real time feedback includes audio, visual or vibratory cues provided by actuators 1204 and display 1202.

If the sensors indicate a dangerous condition, such as abnormal pulse rate, an alarm condition is triggered which may include an alarm report and a request for assistance via the network connected external processor 1250 (blocks 1520 and 1522).

At the end of the programmed workout (block 1528), with all reps of all routines executed within required parameters, information regarding the workout, including actual measurements of forces and torques, are uploaded to the external computing device 1250 for further analysis. As an example, the uploading process may be done through a direct Bluetooth connection, via a local Wi-Fi router or through the cloud 1256. In an embodiment, external computing device 1250 may log the workout information or analyze and report the effort expenditures of each muscle and muscle group.

The workout information may be made available only to the user or to user authorized third parties such as a trainer or medical professional. FIG. 12B depicts a smart grip application displayed on user interface 1254 that includes a current status of a biceps curls routine and the muscles loaded by that routine. At the end of the workout at block 1528, a report is made available which summarizes the work expanded per muscle or muscle group.

Figure 16A:
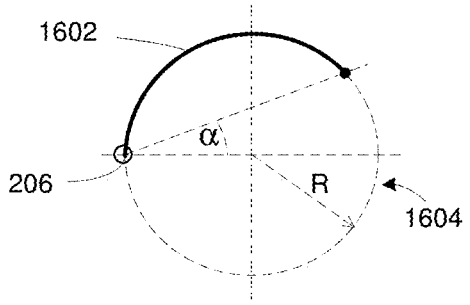
FIGS. 16A-16D depict a dimensioning of a smart grip according to embodiments.

FIGS. 16A-16D depict an example of smart grip 1600 to accommodate handlebars of varying diameter. Smart grip 1600 comprises two halves, each half comprising an arc 1602 joined at hinge 206. FIG. 16A depicts each arc 1602 of smart grip 1600 as a segment of a circle 1604 having a radius R and a cut angle α. The radius R and the cut angle α determine a minimum radius (Rhmin) and a maximum radius (Rhmax) of a handlebar 104 accommodated by smart grip 1600.

Figure 16B:
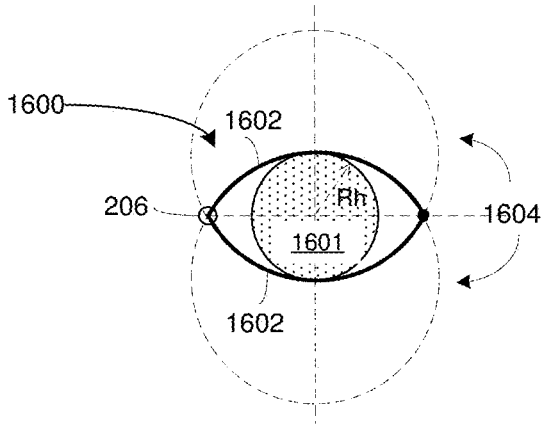

FIG. 16B depicts a smart grip 1600 of a given R and α, fully encircling handlebar 1601, capable of measuring forces developed between the smart grip 1600 and handlebar 1601. The minimum radius (Rhmin) of handlebar 1601 that can be grasped by a fully closed smart grip 1600 of a given R and α is as follows:

$$Rh\min=R*(1-\sin\alpha)$$

Figure 16C:
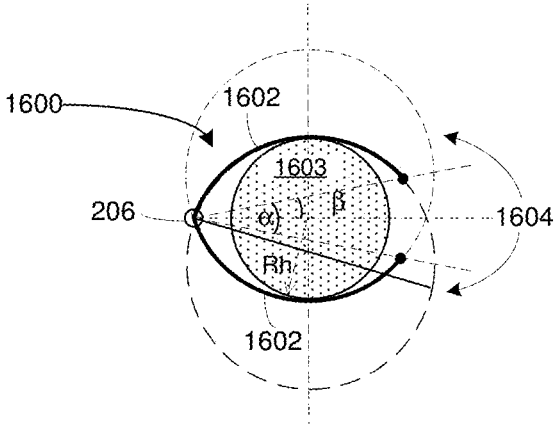

FIG. 16C depicts a smart grip 1600 engaging a handlebar 1603 with a radius smaller than Rhmax and bigger than Rhmin, where α is greater or equal to 0 degrees, and less than or equal to 45 degrees, and Rhmax is equal to R. To accommodate handlebar 1603, the two arcs 1602 of smart grip 1600 rotate an angle of β in opposite directions around hinge 206:

$$\beta=\alpha-\arcsin[1-(Rh/R)]$$

Figure 16D:
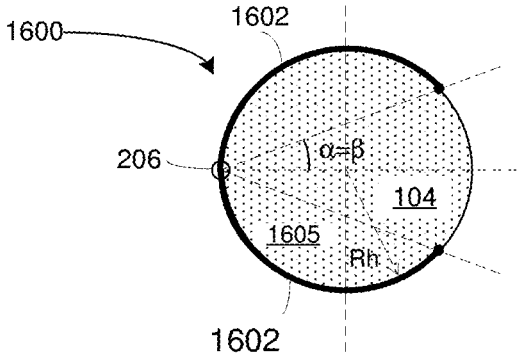

FIG. 16D depicts a maximally sized handlebar 1605 (radius Rh) being grasped by smart grip 1600. As depicted, each arc 1602 of smart grip 1600 has an angular opening β=α with hinge 206.

Figure 17A:
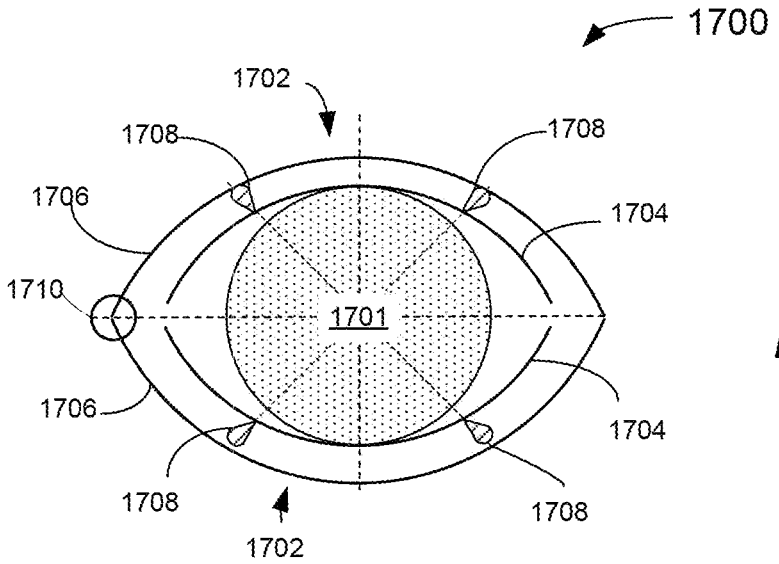
FIGS. 17A-17B depict measuring forces applied to a smart grip according to embodiments.
Figure 17B:
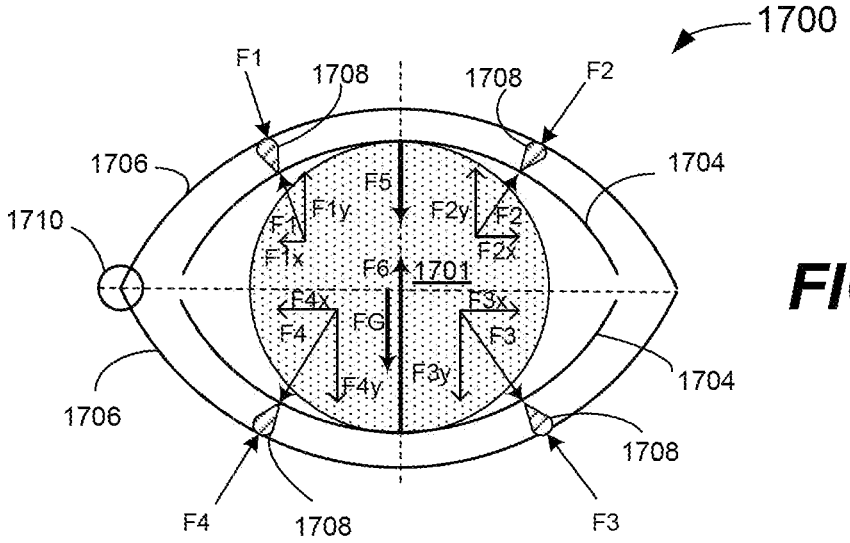

An embodiment of smart grip 1700 is depicted in FIG. 17A and FIG. 17B and measures forces applied by a strength training equipment, e.g., a dumbbell in Earth's gravitational field, and balanced by body muscles. Smart grip 1700 comprises two halves 1702, each half 1702 comprising an inner force adaptor plate 1704 in contact with handlebar 1701 of the dumbbell and an outer grip segment 1706 in contact with a user's hand. Separating the inner force adaptor plates 1704 and outer grip segments 1706 are a number of one-dimensional force sensors 1708 that measure forces F1, F2, F3, and F4 developed between the force adaptor plates 1704 and grip segments 1706. The two halves 1702 of smart grip 1700 are mechanically connected by a connecting member 1710.

In a stationary case (FIG. 17B), assuming equilibrium, a dumbbell 1701 is subject to a gravitational force:

$$FG=M*g$$

where M is a mass of the dumbbell and g is the gravitational acceleration (9.81 m/sec$^2$).

In addition, with analysis limited to the x-y plane:

$$F5=F1y+F2y$$

$$F6=F3y+F4y$$

$$FG=F6-F5$$

Because the embodiment depicted in FIG. 17B uses one-dimensional force sensors 1708, calculation of the components F1$y$, F2$y$, F3$y$, F4$y$, F1$x$, F2$x$, F3$x$, and F4$x$ of forces F1-F4 requires knowledge of the direction of the gravitational acceleration g which is provided by accelerometers integral to local physical sensors 1308. Under ideal balance conditions, F1$x$, F2$x$, F3$x$, and F4$x$, are horizontal components of F1-F4, and balance each other out.

Holding or lifting the dumbbell exercises primarily biceps muscle via the torque it must develop to support the weight of the dumbbell. Given the deployment of force sensors 1708 around the smart grip 1700, in addition to measuring the FG force supporting the weigh, smart grip 1700 also measures F5 by itself, which is a measure of a squeezing force applied to grip 1700. Measuring the squeezing force quantifies an effort expanded by the wrist, finger, and thumb flexor muscles of the hand, which would not be possible with an embodiment using only accelerometers.

FIG. 17B illustrates a two-dimensional operation of the smart grip 1700. A similar analysis can be extended to an embodiment of a smart grip that includes three-dimensional force sensors such as those depicted in FIG. 5 and FIG. 6D.

Figure 18A:
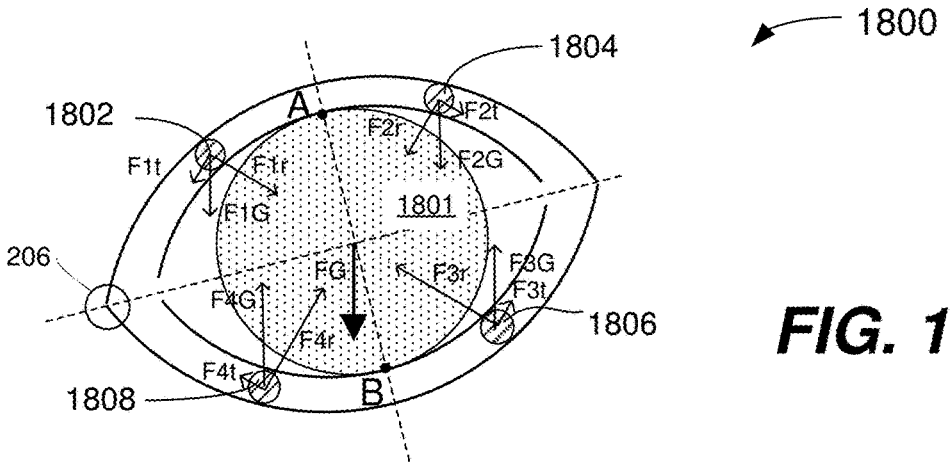
FIGS. 18A-18C depict a smart grip with two-dimensional force sensors according to embodiments.
Figure 18B:
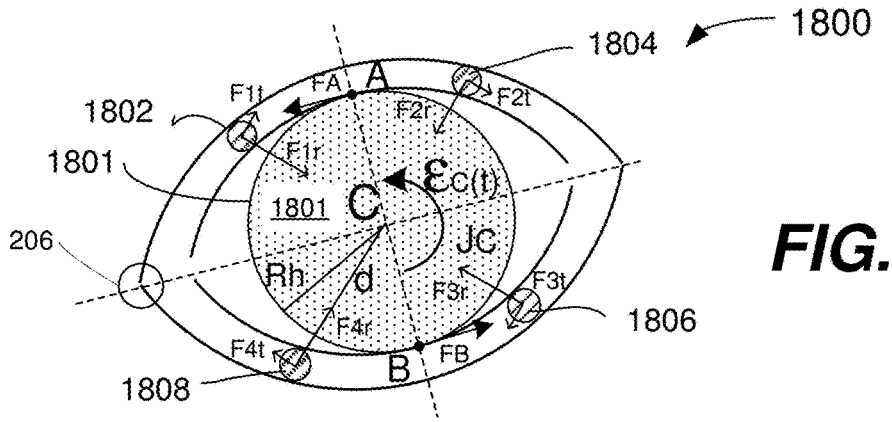
Figure 18C:
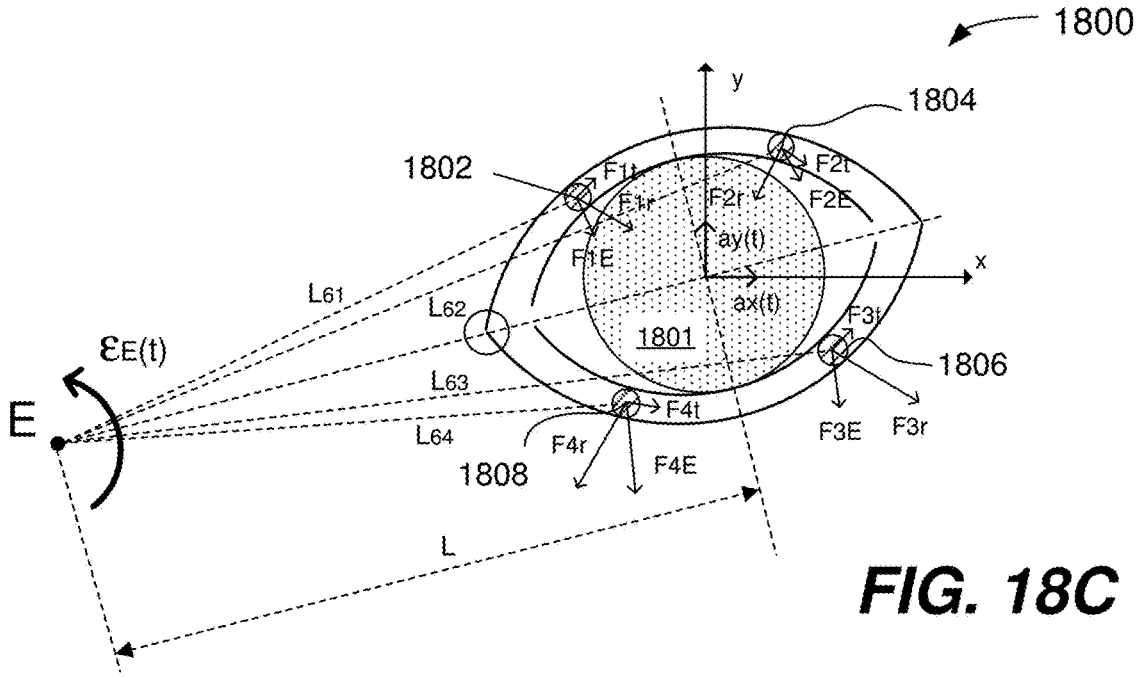

FIGS. 18A-18C depicts two-dimensional force sensors 1802, 1804, 1806, 1808 where each force sensor independently measures a radial force Fir and tangential force Fit, where i is equal to 1, 2, 3 or 4. FIG. 18A demonstrates a static situation where gravitational force FG, as described below, is equal to a balance of vertical components of all four two-dimensional force sensors 1802, 1804, 1806 and 1808.

$$FG=F3G+F4G-F1G-F2G$$

Where for two-dimensional force sensor 1802, F1G is the sum of vertical force components F1$r$ and F1$t$. Similarly, for two-dimensional force sensors for, sensors 1804, 1806, and 1808, values F2G, F3G, and F4G are sums of vertical force components of F2$r$ and F2$t$, F3$r$ and F3$t$, and F4$r$ and F4$t$, respectively. A vertical direction determined by accelerometers integral to local physical sensors 1308.

FIG. 18B depicts a smart grip 1800 fully encircling a dumbbell handlebar 1801 with a moment of inertia Jc around the dumbbell's longitudinal axis, that is subjected to a counterclockwise torque in zero gravity. With all radial components balanced out, the torque applied to the handlebar results in equal forces FA and FB applied to the handlebar at contact points A and B respectively which combine into a driving torque (FA+FB)*Rh, where Rh is the radius of the handlebar. This torque is opposed by an inertial resistance torque Jc*εC(t), where εC(t) is the angular acceleration of the dumbbell around its longitudinal axis. If Jc is not known but the tangential forces F1$t$, F2$t$, F3$t$ and F4$t$ are measured by the two-dimensional force sensors 1802, 1804, 1806 and 1808, the resistance torque is also equal to (F1$t$+F2$t$+F3$t$+F4$t$)*d, where d is the distance from the sensors to the longitudinal axis of the handlebar 1801.

FIG. 18C depicts forces generated by a user with an unknown forearm geometry executing a biceps curl around the elbow axis E with a dumbbell of unknown mass and unknown moment of inertia. During the resulting motion, built-in accelerometers of local physical sensors 1308 measure the angular acceleration εE(t) around the elbow E. By twice integrating the linear accelerations ax(t) and ay(t), the path of the dumbbell's travel may be mapped, including a position of the elbow E with respect to the dumbbell. This information allows the computation of the torque arms L61, L62, L63 and L64, which together with the force components F1E, F2E, F3E and F4E perpendicular to the said torque arms, determines TE, the total torque resisting the motion of the user's forearm, as follows:

$$TE=L61*F1E+L62*F2E+L63*F3E+L64*F4E$$

Where F1E, F2E, F3E and F4E are the components of forces F1$r$, F1$t$, F2$r$, F2$t$, F3$r$, F3$t$, F4$r$, F4$t$ perpendicular to the torque arms L61, L62, L63, L64, and the orientation with respect to gravity given by the accelerometers integrated in 1308. The work being done by the user's biceps is then:

$$W=\int TEd\theta;\theta=\iint_0^t \varepsilon E(t')dt'dt$$

Where εE(t) is the real time measurement of the angular acceleration around the elbow measured by the grip mounted accelerometers.

Figure 19A:
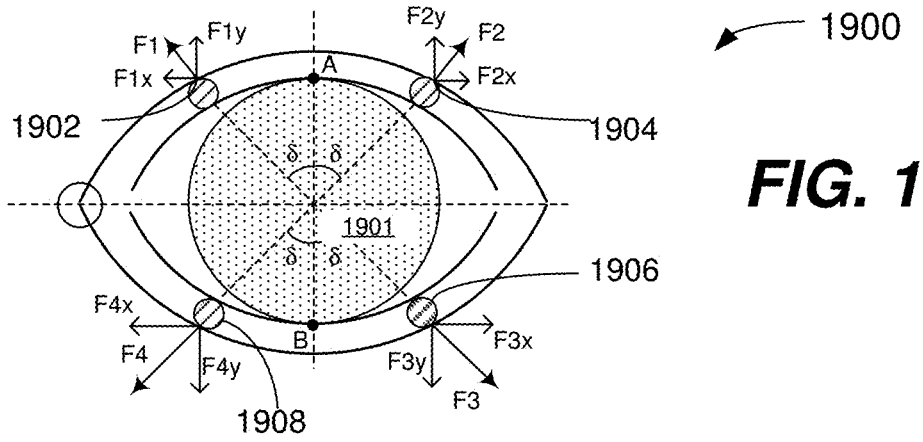
FIGS. 19A-19C depict a smart grip engaging a handlebar of varying diameters.
Figure 19B:
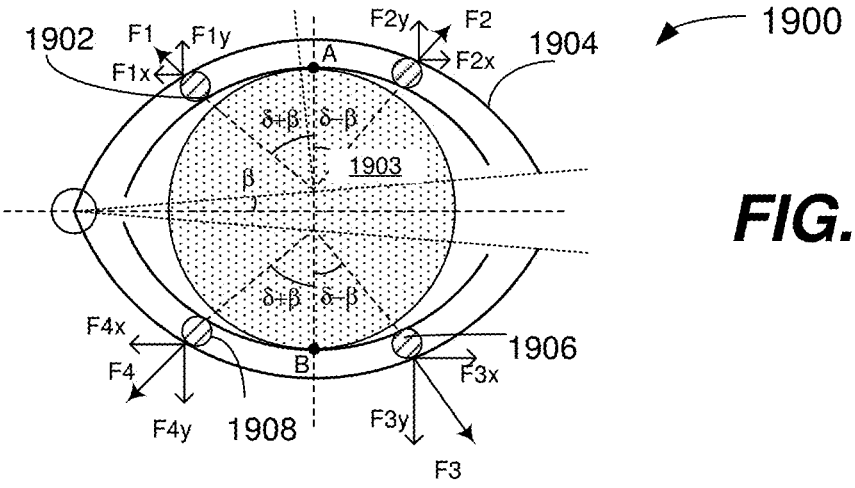
Figure 19C:
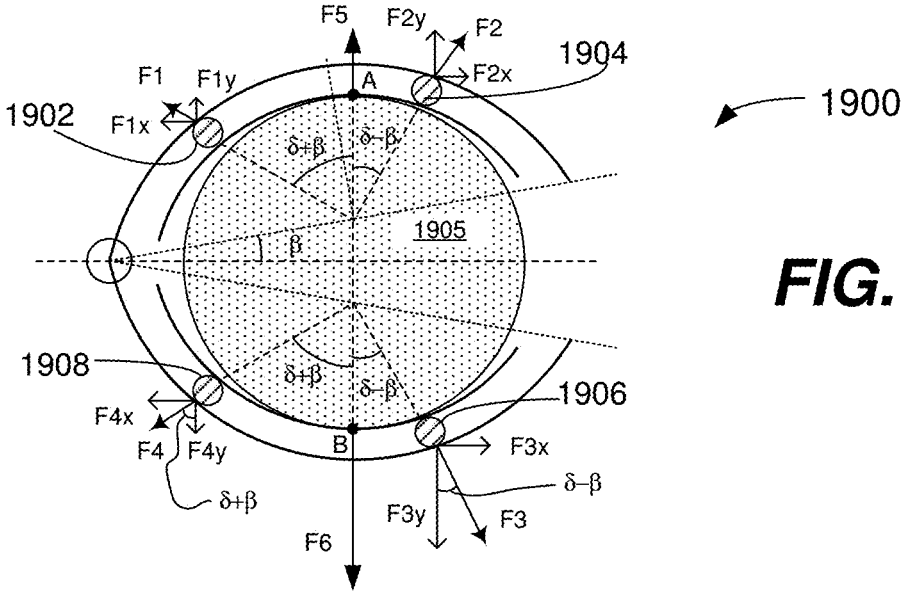

FIGS. 19A-19C depict smart grip 1900 engaging handlebar 1901, 1903, and 1903, of varying diameters. In disclosed embodiments, smart grip processor 1312 determines a diameter of handlebars 1901, 1903, and 1905, and uses the diameter to calculate a position and orientation of the sensors 1902, 1904, 1906 and 1908. More specifically, FIGS. 19A, 19B and 19C depict a method of calculating how open (angle β) smart grip 102 needs to be to accommodate a handlebar of unknown radius Rh.

FIG. 19A depicts an embodiment of smart grip 1900 in which smart grip 1900 fully closes around handlebar 1901 and force sensors 1902, 1904, 1906 and 1908 are located symmetrically around a vertical axis at an angle δ.

FIG. 19B depicts smart grip 1900 open by an angle β around handlebar 1903. Smart grip 1900 repositions force sensors 1902, 1904, 1906, and 1908 into an asymmetrical configuration with force sensors 1902 and 1908 making an angle of δ+β with the vertical and force sensors 1904 and 1906 making an angle of δ+β with the vertical.

FIG. 19C depicts smart grip 1900 encircling a handlebar 1905 greater in diameter than handlebar 1903. If the user does not squeeze the handlebar (F1=0, F2=0) and the smart grip is in equilibrium (all torques in balance and horizontal components F1$x$, F2$x$, F3$x$, F4$x$ balanced out) in horizontal position $$F4y/F3y=\sin(\delta-\beta)/\sin(\delta+\beta)$$

Where δ is known and F4$y$ and F3$y$ are the values of the vertical components of the forces F4 and F3 measured by the sensors 1808 and 1806 respectively. In an example, δ=45 degrees and $$\beta=\arctan\{[1-(F4y/F3y)]/[1+(F4y/F3y)]\}$$

Processor 1312 calculates a radius Rh of a handlebar as:

$$Rh=R*[1-\sin(\alpha+\beta)]$$

Knowledge of β, Rh and of a geometry of smart grip 1900 enables calculation of relevant force and torque components, and a calculation of work done against equipment resistance.

In embodiments, electronic components include one or more hardware processors, a computer readable medium, which may be non-transitory, such as hardware storage devices (e.g., RAM (random access memory), ROM (read only memory), EPROM (erasable, programmable ROM), EEPROM (electrically erasable, programmable ROM), and flash memory). The methods, functions and other processes described herein may be embodied as machine readable instructions stored on the computer readable medium.

While the embodiments have been described with reference to examples, various modifications to the described embodiments may be made without departing from the scope of the claimed embodiments.

The invention claimed is:

1. A strength training apparatus comprising a grip device to encircle a handlebar of a weight training piece of equipment, the grip device comprising:

a plurality of segments, each segment of the plurality of segments joined to at least one other segment by a connecting member, the connecting member to urge together the plurality of segments around the handlebar, wherein each segment comprises an inner surface and a plurality of force sensors dispersed across the inner surface, the plurality of force sensors facing inward towards a center of the urged together plurality of segments;

a plurality of force adapter plates disposed between the inner surface of the plurality of segments and the handlebar; and circuitry to receive and process force information collected by the plurality of force sensors.

2. The strength training device of claim 1, wherein each of the plurality of force adapter plates includes a rigid surface resting on the plurality of force sensors and a thin pliable material on a handlebar facing surface.

3. The grip device of claim 2, wherein the plurality of force sensors includes radial force sensors.

4. The grip device of claim 2 further comprising a first set of protrusions disposed on the inner surfaces of the plurality of segments and a second set of protrusions disposed on an outer surface of the plurality of force adapter plates mechanically opposing the first set of protrusions, wherein the plurality of force sensors includes radial force sensors, tangential force sensors, and axial force sensors disposed on the first set of protrusions.

5. The grip device of claim 2 wherein the plurality of force sensors includes force sensors to collect radial, tangential, and axial force information.

6. The grip device of claim 1 further comprising orientation, acceleration and timing sensors.

7. The grip device of claim 1, wherein the circuitry to receive and process force information includes a processor, a memory device, and a user interface panel, the user interface panel including input and output devices.

8. The strength training apparatus of claim 7, wherein the processor determines a grip angle opening the grip device must open to accommodate a diameter of the handlebar and uses the determined grip angle opening to calculate a position and orientation of the force sensors.

9. The strength training apparatus of claim 1 further comprising an external computing device in wireless communication with the grip device, the external computing device to transmit workout information to the grip device, and to receive and process the force information received and processed by the grip device.

10. The strength training apparatus of claim 1 further comprising an enclosure dimensioned to enclose the grip device in an open position, the enclosure comprising a top plate and a bottom plate, the top plate having a flat upper surface and a contoured lower surface, and the bottom plate having a contoured upper surface and a flat lower surface, wherein the inner surface of each segment is spaced apart from the contoured upper surface, and the plurality of force sensors are positioned to directly engage the contoured upper surface when force is applied to the top plate.

11. A method of tracking a strength training workout, comprising:

receiving, by a processor disposed within a grip device comprising joined segments, force measurements from sensors disposed within the segments, the segments surrounding a handlebar of a weight training piece of equipment;

calculating by the processor a position and orientation of the sensors by calculating a grip angle opening of the grip device accommodating a diameter of the handlebar; and using the calculated position and orientation of the sensors, monitoring exercise parameters specific to execution of the strength training workout, the exercise parameters including data provided by the sensors.

12. The method of claim 11, whereby receiving force measurements from sensors disposed within the segments includes receiving radial and tangential force measurements from the force sensors.

13. The method of claim 11, whereby receiving force measurements from sensors disposed within the segments includes receiving radial, tangential, and axial force measurements from the force sensors.

14. The method of claim 11, further comprising:

receiving, by the grip device, a workout profile; and determining whether the monitored exercise parameters are consistent with the strength training workout.

15. The method of claim 11, further comprising:

uploading, from the grip device, information related to forces and torques pertaining to the strength training workout to an external computing device.

16. A strength training grip device comprising:

at least two joined segments, the joined segments dimensioned to at least partially surround a handlebar of a weight training equipment, wherein each segment comprises an inner surface and at least one force sensor disposed across the inner surface, the at least one force sensor to measure force in at least one direction; and force adapter plates disposed between the inner surface of each segment and the handlebar.

17. The grip device of claim 16, the force adapter plates having first and second sides, the first side of each force adapter plate resting on the at least one force sensor, and the second side of each force adapter plate facing the handlebar.

18. The grip device of claim 17 further comprising a first set of protrusions disposed on the inner surface of each segment and a second set of protrusions disposed on the first side of each force adapter plate, wherein the force sensors are disposed on the first set of protrusions and the second set of protrusions are mechanically opposing the first set of protrusions.

19. The grip device of claim 16, wherein the at least one force sensor measures radial and tangential force information.

20. The grip device of claim 16, wherein the at least one force sensor measures radial, tangential, and axial force information.

* * * * *